US005904284A

United States Patent [19]

Lin

[11] Patent Number: 5,904,284

[45] Date of Patent: May 18, 1999

[54] EXPLOSIVELY ACTUATED FASTENER SYSTEM AND METHOD OF APPLICATION THEREOF

[76] Inventor: Joe Lin, 4114 King Cotton La., Missouri City, Tex. 77459

[21] Appl. No.: 09/019,613

[22] Filed: Feb. 6, 1998

[51] Int. Cl.[6] ..... B25C 1/08

[52] U.S. Cl. ..... 227/11; 227/9; 227/132; 227/146; 227/8

[58] Field of Search ..... 227/9, 10, 11, 227/132, 146, 147, 8; 173/53, 55

[56] References Cited

U.S. PATENT DOCUMENTS

| | | | |
|---|---|---|---|
| 2,660,726 | 12/1953 | Weingart | 227/11 |
| 2,765,463 | 10/1956 | De Anguera | 227/146 |
| 2,774,133 | 12/1956 | Sitz | 227/132 |
| 3,105,238 | 10/1963 | Hilti | 227/10 |
| 3,162,123 | 12/1964 | Turner | 227/9 |
| 3,172,123 | 3/1965 | Helderman et al. . | |
| 3,177,952 | 4/1965 | West | 173/55 |
| 3,473,718 | 10/1969 | Wackrow | 227/10 |
| 3,514,025 | 5/1970 | Hsu et al. . | |
| 3,665,583 | 5/1972 | Helderman . | |
| 3,797,721 | 3/1974 | Clumb . | |
| 4,492,329 | 1/1985 | Benson et al. | 227/10 |
| 4,741,467 | 5/1988 | Gassner et al. | 227/8 |
| 4,830,254 | 5/1989 | Hsu . | |
| 4,867,365 | 9/1989 | Buechel et al. | 227/10 |
| 4,890,778 | 1/1990 | Hawkins . | |
| 4,899,919 | 2/1990 | Clumb . | |
| 4,907,928 | 3/1990 | Beck et al. . | |
| 5,016,802 | 5/1991 | Haytayan . | |
| 5,135,150 | 8/1992 | Chun . | |
| 5,282,564 | 2/1994 | Vigil Rio | 227/132 |
| 5,423,469 | 6/1995 | Armstrong . | |
| 5,497,929 | 3/1996 | Armstrong . | |
| 5,544,800 | 8/1996 | Armstrong . | |

*Primary Examiner*—Scott A. Smith
*Assistant Examiner*—James P. Calve
*Attorney, Agent, or Firm*—Maryam Bani-Jamali; John R Casperson

[57] ABSTRACT

An explosively actuated fastener system comprises an open-ended outer tubular member; an open-ended tubular cap being attached to the back end of the outer tubular member having an inward circular protrusion at its back end; an open-ended barrel member connecting the muzzle to the outer tubular member; an open-ended inner tubular member with an outward circular protrusion and an inward circular protrusion being positioned at the front end; a reciprocable ejector comprising a retaining section and a firing rod that comprises a front section, a middle section and a back section; an ejector housing comprising a tube and a firing pin that extends forwardly from the tube; a forward spring being positioned within the inner tubular member; a balancing spring being positioned within the outer tubular member; a handle being attached to the back end of the inner tubular member; an open-ended sliding guide being positioned in front of the outward circular protrusion of the inner tubular member and within the outer tubular member; a reset spring being fitted around the front part of the sliding guide and being positioned between the ejector housing and the sliding guide and a pin means being fitted in the number of perforations in the back section of the ejector housing.

32 Claims, 5 Drawing Sheets

EXPLOSIVELY ACTUATED FASTENER SYSTEM AND METHOD OF APPLICATION THEREOF

BACKGROUND OF THE INVENTION

1. Field of the Invention

This invention relates to an improved explosively actuated fastener system and method of application thereof.

2. Description of the Prior Art

In the past few decades, various forms of explosively actuated fastener systems have been developed to drive components such as fasteners into hard structures consisting of wood, concrete, masonry and steel. A considerable advantage of using such fastener systems has been the small time required for fastening fasteners to hard structures. However, a major common disadvantage is that the fasteners cause high stresses when penetrating into the receiving material in the region of the fastening whereby greater spalling occurs. In addition, explosively actuated fastener systems are relatively complex in construction and costly to manufacture and, due to inadequate venting of their combustion chamber, suffer from disadvantages that they are relatively noisy and tend to jam from a buildup of spent powder.

Explosively actuated fastener systems have been previously divided into two general groups: the low-velocity fastener system (discharging fasteners at a velocity of less tan about 300 ft/sec) and the high-velocity fastener system (discharging fasteners at a velocity of greater than about 500 ft/sec). A drivepin is positioned at the exit end of a cylindrical barrel of the low-velocity fastener system, with a piston located inwardly and spaced from the drivepin and an explosive charge located behind the piston. A drivepin is positioned behind the piston of the high-velocity fastener system. Despite years of development in high-velocity and low-velocity fastener systems, some disadvantages still exist in numerous versions of such fastener systems. Some high-velocity fastener systems still have the disadvantages of high noise level, dangerous free fastener velocity and high degree of spall and ricochet when the drivepin strikes the work surface. Some low-velocity fastener systems still have the disadvantage of high noise level, power limitation, severe spall out in concrete and high incidence of drivepin damage.

With the fastener systems being ballistic in nature and the fasteners attaining free flight, the fastener systems have achieved safety concerns analogous to handling firearms. The present improved explosively actuated fastener system, which is adapted to provide a means for driving a fastener, has the driving capacity of a high-velocity fastener system and the safety of a low-velocity fastener system, in addition to containing a uniquely simple structure with a minimal number of parts among existing similar marketed goods, a low noise level and reduced drivepin and work damage.

Unlike ballistic fastener systems in which fasteners achieve free flight, zero stand-off fastener systems do not achieve free flight of the fasteners. The zero stand-off fastener systems have a handle that is long enough to ensure that the positioning of the fastener and a work surface is sufficiently close to prevent free flight of the fastener. Thus, the fastener enters the work surface directly from the fastener system. A number of poles are attached to the handle to obtain the sufficient length needed by the zero stand-off fastener system to provide a direct entrance of the fastener from the fastener system into the work surface. Thus, by reducing similarities to firearms and by reducing ballistic features, the zero stand-off fastener systems are safer, but often at the expense of sufficient power to achieve the desired holding penetration in a work surface since the presence of the work surface is a necessary prerequisite to actuating the firing of the solid propellant pill. In prior art, as a result of the co-application of the work surface, barrel, solid propellant pill and fastener, with the fastener functioning as a firing pin, a non-ballistic system is provided. Unfortunately, in the prior art fastener systems, the power achieved and hence the degree of penetration of the fastener into the target structure are limited for zero stand-off fastener systems. In the present invention, there is a major increase in the force exerted on the fastener for a set amount of pressure exerted on the handle of the fastener system.

By deleting some steps required in loading, attempts have been made to simplify and speeden up the use of fastener systems. Designs of power loads have been adjusted to lead to a decrease in required parts, and thus a decrease in cost of production, of fastener systems. Lower costs have also served as a goal to be achieved by increasing applications of versions of fastener systems and by increasing variations in structure of each version of the fastener system without departing from the scope of that version.

In addition, fastener systems have been designed to assure control by the user of the distance traveled by the fastener, the speed of the fastener, the power of the fastener and the depth of insertion of the fastener into the work piece, to name a few. It has been desired that such control by the user would be accompanied by as few changes in the fastener system as possible for fasteners of different weight, shape, length, width, thickness, material and other physical and chemical properties. Another factor that is considered in designing fastener systems is the minimization of problems in the application of the fastener system.

As examples, several patents that have been issued in the past few decades and are aimed at improving power loads follow:

In U.S. Pat. No. 5,544,800, registered on Aug. 13, 1996, U.S. Pat. No. 5,497,929, registered on Mar. 12, 1996, and U.S. Pat. No. 5,423,469, registered on Jun. 13, 1995, Armstrong discusses a system for driving a fastener into a work surface. The system comprises a fastener having a penetration end, a shaft and a receptacle head end for receiving a power charge and a tool having a reciprocable firing pin. The tool comprises a barrel including a bore having a muzzle for receiving the fastener, a spring-biased firing pin and an exhaust chamber connected to the bore for receiving exhaust gases.

In U.S. Pat. No. 5,135,150, registered on Aug. 4, 1992, Chun discusses a pole-type powder actuated tool that includes a first pin having a flange at the top end, a second pin having a flange at the top end in contact with the flange of the first pin so that the second pin will move in unison with the first pin, a front barrel for receiving a drive pin and cartridge, a rear barrel for accommodating the second pin and part of the first pin and engaged with the front barrel at one end and with a connecting pipe at the other end, two springs enclosing the first pin and second pin for forcing the two pins to the normal position after fired.

In U.S. Pat. No. 5,016,802, registered on May 21, 1991, Haytayan discusses an explosive actuated extendable driving tool having a housing with a barrel at its front end for receiving a fastening element, with a load chamber in an inner end of the barrel. A manually actuated reciprocatable positioned shaft is slidably received in a retainer that is mounted to the back end of the housing. A muzzle with a self-aligning spall guard and splash guard are mounted to the barrel, with a noise suppression element being contained in a chamber formed between the spall guard and the splash guard. Exits for the discharge of combustion gases and carbon into the noise suppression element are defined by discharge ports formed in the barrel and spall guard.

Clumb, in U.S. Pat. No. 4,899,919, issued on Feb. 13, 1990, patents a self-energizing fastener system which comprises a fastener and a deflagratable propellant pellet.

Hawkins, in U.S. Pat. No. 4,890,778, issued on Jan. 2, 1990, patents a hammer-activated fastener tool for driving fastener projectiles comprising a relatively movable barrel and housing components. The barrel carries a power load chamber body and a relatively movable piston member which in muzzleward movement drives the fastener object and on breechward movement achieves ejection of the spent power load cartridge. The housing carries a movable firing pin assembly.

Hsu, in U.S. Pat. No. 4,830,254, issued on May 16, 1989, patents a two-stage power driving system for powder actuated tools comprising a barrel, a piston, a first stage power load activation means and a power amplifier. The power amplifier accommodates a stacked arrangement of a fastener and a second stage power load.

In U.S. Pat. No. 3,797,721, issued to Clumb on Mar. 19, 1974, an explosive actuated tool for driving fastening stud is patented and comprises a barrel with a bore. Muzzle is provided at one end of barrel and explosion chamber communicates with the bore. Closed gas expansion chamber surrounds barrel and communicates with bore solely through plurality of passageways in barrel adjacent muzzle.

Helderman, U.S. Pat. No. 3,665,583, issued on May 30, 1972, patents a suspension clip structure which includes a center portion and a projecting retaining flange for facilitating the holding of the suspension clip structure on a power actuated tool.

Hsu et al., U.S. Pat. No. 3,514,025, issued on Oct. 30, 1967, present an electrically operated explosively actuated tool using a caseless cartridge.

Helderman et al., U.S. Pat. No. 3,172,123, issued on Mar. 9, 1965, discuss an explosive actuated tool in which a spring-loaded barrel with a bore is forced toward a work surface, thus forcing a fastener into the bore of the barrel. The fastener acts as a firing pin for igniting a power charge disposed at a head end of the fastener.

The above-listed patents and many other similar inventions have been developed, some of which still exist in the market. This invention strives towards providing an improved explosively actuated fastener system and a method of application thereof. Cased solid propellant pills, with coatings qualifying as cases as well, can be separately and individually loaded in the fastener system. (Unless otherwise specified, any reference to "case" in this invention applies to "coating" as well.) In the fastener system, each manufactured version of a cased solid propellant pill may be used with numerous versions of fasteners. By matching a cased solid propellant pill with a chosen fastener and with a selected fastener system, the user may control the distance traveled by the fastener, the speed of the fastener, the power of the fastener and the depth of insertion of the fastener into a work piece, to name a few.

SUMMARY OF THE INVENTION

A primary object of this invention is to devise a fastener system that, in comparison to existing fastener systems and with equal amounts of propellant, propels a fastener out of the fastener system at higher power due to higher pressures and, as a result, conserves energy and increases the efficiency of application of the fastener system.

Another object of the invention is to design a fastener system that assures control by a user of the distance traveled by a fastener of defined weight, shape, length, width, thickness, material and other physical and chemical properties, the power of the fastener and the depth of insertion of the fastener into a work piece.

Still another object of the invention is to devise a fastener system that can be easily, separately, conveniently and safely transferred, handled and used.

Yet another object of the invention is to devise a fastener system that, by having a smaller number of required parts simplifies production of the fastener system and results in a decrease in costs of production of the fastener system.

An additional object of the invention is to devise a fastener system that, by deleting or changing some steps and components required in loading and ignition of existing fastener systems, simplifies and speedens up insertion of a fastener into a desired surface.

Another object of this invention is to devise a fastener system that protects any included propellant from the surrounding environment, minimizes environmental pollution and provides a thermal barrier against accidental ignition, but does not leave a case to be extracted after utilization of the propellant.

An additional object of the invention is to provide a fastener system that prevents a leakage of any corrosive gas from a solid propellant pill beyond positioning of the solid propellant pill into the fastener system.

Another objet of the invention is to minimize noise level of the fastener system.

A further object of this invention is to provide a fastener system that is light-weight, compact, durable and easy to operate.

A final goal of the invention is to design a fastener system that maximizes the safety of and that minimizes problems in the application of the fastener system.

Additional objects and advantages of the invention will be set forth in part in a detailed description which follows, and in part will be obvious from the description, or may be learned by practice of the invention.

The present invention provides an improved explosively actuated fastener system. The explosively actuated fastener system comprises a front end; a back end; an open-ended muzzle being positioned adjacent to the front end of the fastener system; an open-ended outer tubular member having a front end and a back end; an open-ended tubular cap being attached to the back end of the outer tubular member and having a front end and a back end and an inward circular protrusion at the back end; an open-ended barrel member including an axial, central bore and extending from within, being an integral continuation of, and thus connecting, the muzzle to the outer tubular member; an open-ended inner tubular member having a front end and a back end, with an outward circular protrusion and an inward circular protrusion being positioned at the front end; a reciprocable ejector comprising a retaining section positioned in the inner tubular member, an outward circular protrusion and a firng rod, that extends forwardly from the retaining section, that comprises a front section, a middle section and a back section and that is separated from the retaining section by the outward circular protrusion; an ejector housing being used for accommodating the reciprocable ejector and comprising a tube, an outward circular protrusion and a firing pin that extends forwardly from the tube, with the tube comprising a closed top, an open bottom, a front section that is smaller in diameter than the axial, central bore of the barrel member, a middle section and a back section that is separated from the middle section by the outward circular protrusion and that has a number of perforations; a forward spring being positioned within the inner tubular member; a balancing spring being positioned within the outer tubular member; a handle being attached to and serving as a closure for the back end of the inner tubular member; an open-ended sliding guide comprising a tubular main body and a front part that at its front edge has an inward circular protrusion and being positioned in front of the outward circular protrusion of the inner tubular member and within the outer tubular member; a reset spring being fitted around the front part of the sliding guide and being positioned between the outward circular protrusion of the ejector housing and the main body of the sliding guide and a pin means being fitted in the number of perforations in the back section of the ejector housing.

The method of application of the improved explosively actuated fastener system is also presented. The handle is first pulled backwards to manually reset the fastener system. The backward movement of the inner tubular member results in opening up of the reset spring, causes the sliding guide to move backward and, thus, causes the pin means to lock. Thus, the pin means is locked. Upon pulling the handle to bring the fastener system to a set position, the handle is pushed forward. The forward push on the handle results in compression of the forward spring and build-up of a striking force that forces the inner tubular member to move forward. The forward movement of the inner tubular member causes the sliding guide to move forward and results in compression of the reset spring. Thus, the pin means is unlocked, allowing the forward spring to open up, and the firing rod moves forward, pushed by the opening forward spring, in the ejector housing and strikes front of the tube and the firing pin of the ejector housing which initiates deflagration or detonation of a solid propellant pill.

It is to be understood that the descriptions of this invention are exemplary and explanatory, but are not restrictive, of the invention. Other objects and advantages of this invention will become apparent from the following specification and from any accompanying charts, tables, examples and drawings.

BRIEF DESCRIPTION OF CHARTS, TABLES, EXAMPLES AND DRAWINGS

Any accompanying charts, tables, examples and drawings which are incorporated in and constitute a part of this specification, illustrate examples of preferred embodiments of the invention and, along with the description, serve to explain the principles of the invention.

DETAILED DESCRIPTION OF THE PREFERRED EMBODIMENT

Preferred embodiments of the present invention are illustrated in any charts, tables, examples and drawings that are included.

The present invention provides an improved explosively actuated fastener system 1 (referred to hereafter as "fastener system 1") for initiating ignition of a solid propellant pill (not shown) that is separately and individually loaded in the fastener system 1, with the solid propellant pill occupying a relatively small portion of the volume of the fastener system 1. The fastener system 1 also initiates energizing of a fastener (not shown) for penetration into a material such as concrete, masonry, wood and steel, to name a few, with the fastener and the solid propellant pill being initially positioned preferably separately but in proximity to one another in the fastener system 1. Although structure, other characteristics and positioning of the solid propellant pill and the fastener are optional, it is most preferable that there is effectively no empty space between the solid propellant pill and the fastener such that a minimal expansion of gases results from ignition of the solid propellant pill. The fastener system 1 also provides means for assuring that the fastener is driven or inserted a controlled amount and to a predetermined depth into the material.

Figure 1:
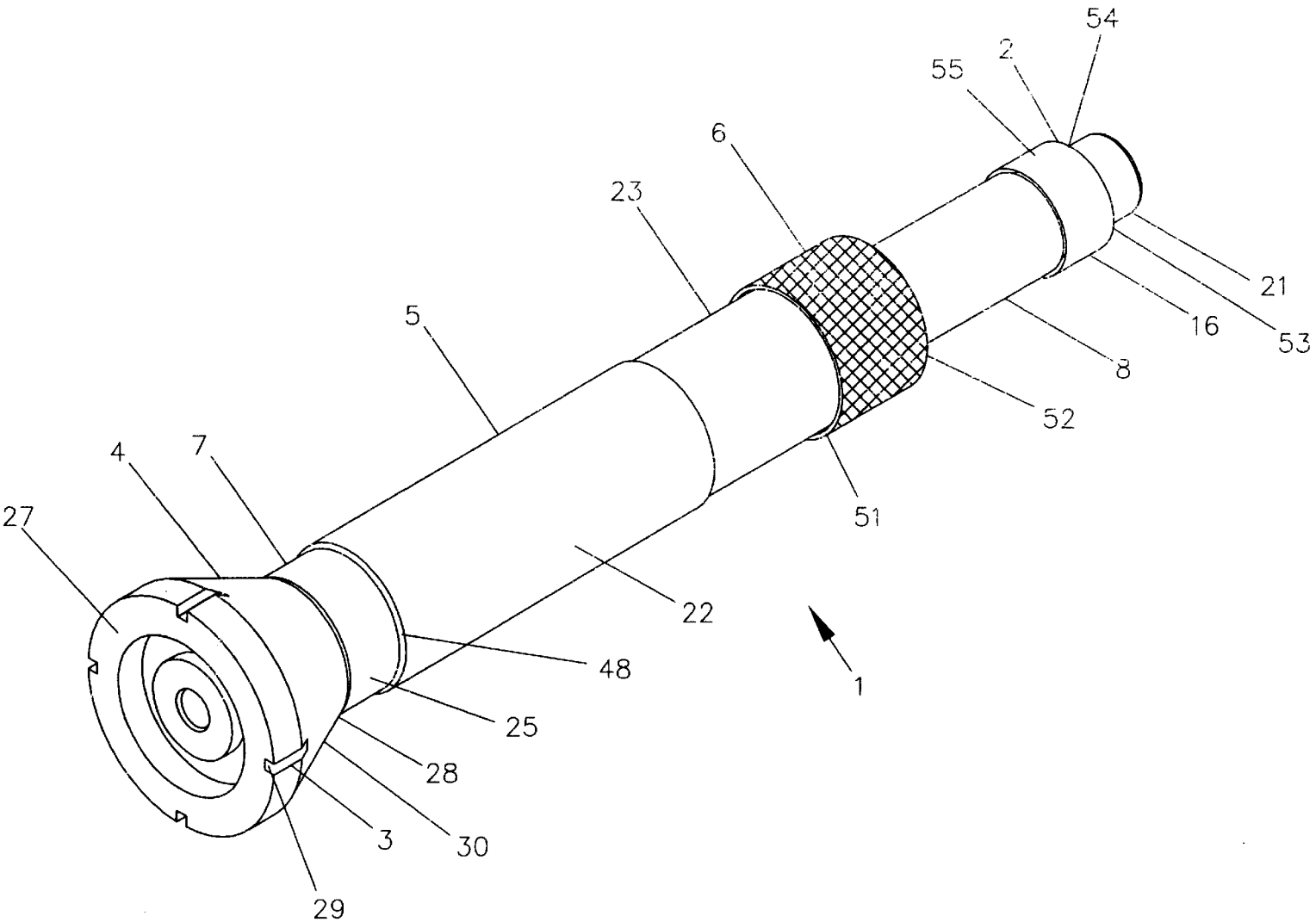
FIG. 1 is an isometric view of a preferred embodiment of an improved explosively actuated fastener system.
Figure 2:
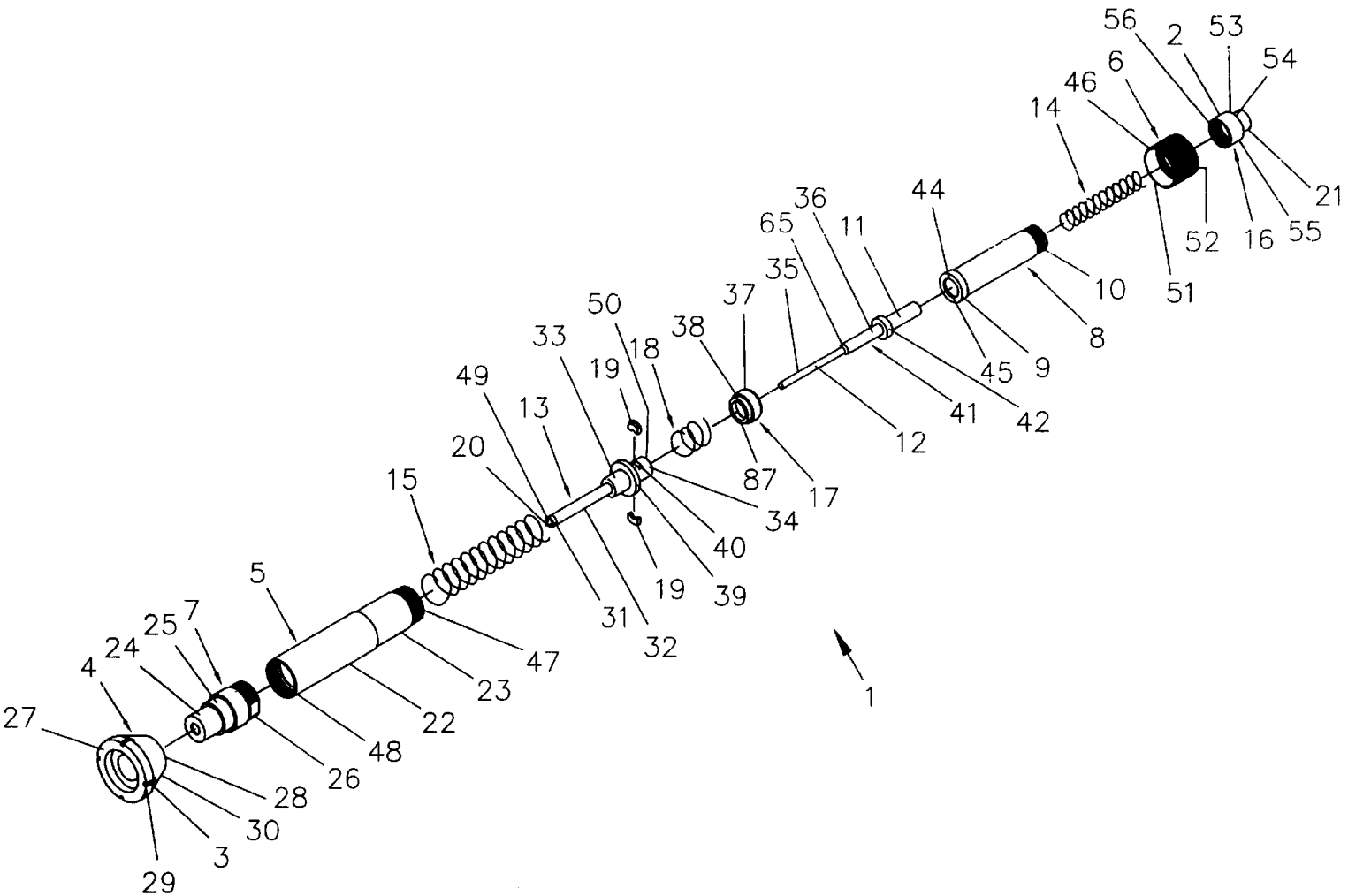
FIG. 2 is an exploded isometric view of the fastener system of FIG. 1.

The fastener system 1 comprises a front end 3; a back end 2; an open-ended muzzle 4 being positioned adjacent to the front end 3 of the fastener system 1; an open-ended outer tubular member 5 having a front end 48 and a back end 47; an open-ended tubular cap 6 being attached to the back end 47 of the outer tubular member 5 and having a front end 51, a back end 52 and an inward circular protrusion 46 at the back end 52; an open-ended barrel member 7 including an axial, central bore that extends through the barrel member 7 and extending from within, being an integral continuation of, and thus connecting, the muzzle 4 to the outer tubular member 5; an open-ended inner tubular member 8 having a front end 9 and a back end 10, with an outward circular protrusion 44 and an inward circular protrusion 45 being positioned at the front end 9; a reciprocable ejector 41 comprising a retaining section 11 positioned in the inner tubular member 8, an outward circular protrusion 42 and a firing rod 12, that extends forwardly from the retaining section 11, that comprises a front section 35, a middle section 65 and a back section 36 and that is separated from the retaining section 11 by the outward circular protrusion 42; an ejector housing 13 being used for accommodating the reciprocable ejector 41 and comprising a tube 31, an outward circular protrusion 39 and a firing pin 20 that extends forwardly from the tube 13, with the tube 31 comprising a closed top 49, an open bottom 50, a front section 32 that is smaller in diameter than the axial, central bore of the barrel member 7, a middle section 33 and a back section 34 that is separated from the middle section 33 by the outward circular protrusion 39 and that has a number of perforations 40; a forward spring 14 being positioned within the inner tubular member 8 for pushing the reciprocable ejector 41 forward; a balancing spring 15 being positioned within the outer tubular member 5; a handle 16 being attached to and serving as a closure for the back end 10 of the inner tubular member 8; an open-ended sliding guide 17 comprising a tubular main body 37 and a front part 38, that at its front edge has an inward circular protrusion 87, and being positioned in front of the inner tubular member 8 and within the outer tubular member 5; a reset spring 18 being fitted around the front part 38 of the sliding guide 17 and being positioned between the outward circular protrusion 39 of the ejector housing 13 and the main body 37 of the sliding guide 17 and a pin means 19 being fitted in the number of perforations 40 in the back section 34 of the ejector housing 13. FIG. 1 shows an isometric view of a preferred embodiment of the fastener system 1. FIG. 2 is an exploded isometric view showing the components of the fastener system 1 as they are assembled together to form the configuration shown in FIG. 1. Thus, a major advantage of the fastener system 1 over previously existing similar systems is that the fastener system 1 eliminates the need for any external screws, spring clips and outer connecting elements which are susceptible to breakage and to disruption of regular application of the fastener system 1.

In a preferred embodiment, the muzzle 4, the barrel member 7, the outer tubular member 5, the inner tubular member 8, the ejector housing 13 (including the tube 31, the outward circular protrusion 39 and the firing pin 20 of the ejector housing 13), the reciprocable ejector 41 (including the firing rod 12, the outward circular protrusion 42 and the retaining section 11 of the reciprocable ejector 41) and the sliding guide 17 (including the main body 37 and the front part 38 of the sliding guide 17) are co-axially aligned. In a preferred embodiment, the handle 16 is also axially aligned with the inner tubular member 8. Various embodiments of handles 16 may be used in the present invention. In a preferred embodiment, the handle 16 consists of a cap 21 and a base 53 that is attached to a portion of the inner tubular member 8 at the back end 10 and that is preferably co-axial with the cap 21 and with the inner tubular member 8. Preferably, the base 53 of the handle 16 is screwed onto the portion of the inner tubular member 8 at the back end 10. The base 53 of the handle 16 serves as a base for the cap 21, as a blockage at the back end 10 of the inner tubular member 8, as a cap for the back end 10 of the inner tubular member 8 and as a blockage for the forward spring 14 positioned in the inner tubular member 8. The base 53 of the handle 16 comprises a closed bottom 54 and a tubular side wall 55 that has a front edge 56. The base 53 has an open front end for insertion therethrough of the back end 10 of the inner tubular member 8. It is the closed bottom 54 of the base 53 that serves as the base for the cap 21 and that blocks the passage of the forward spring 14. The cap 21 extends outwardly from the bottom 54 of the base 53 of the handle 16. The tubular side wall 55 of the base 53 of the handle 16 is larger in diameter than the inward circular protrusion 46 at the back end 52 of the cap 6 and, thus, the entrance of the inner tubular member 8, which is covered by the tubular side wall 55 of the base 53 of the handle 16, into the outer tubular member 5 is stopped when the front edge 56 of the tubular side wall 55 of the base 53 reaches the cap 6 and is blocked by the cap 6. Therefore, a back portion of the inner tubular member 8 that is covered by the tubular side wall 55 of the base 53 is refrained from entering into the outer tubular member 5. With a portion of the inner tubular member 8 at the back end 10 being strongly attached to the base 53, the inner tubular member 8 is not released from the base 53 of the handle 16. After hitting the inward circular protrusion 46 of the cap 6, when the handle 16 returns, the inner tubular member 8 is pulled backward by the handle 16. (Please refer to FIGS. 2, 3A, 3B and 3C.) In previously existing explosively actuated fastener systems, typically handles are limited to a certain type and are not adjustable. In the present invention, the fastener system 1 is readily adaptable to receive extendable members for increasing the length of the fastener system 1 if desired.

Two important features of the fastener system 1 that are related to the inner tubular member 8 are the handle 16 and the forward spring 14. The handle 16 serves most importantly as a means for being pushed in order to cause compression of the forward spring 14 and build up of the desired pressure in the inner tubular member 8. (The handle 16 is pushed after the handle 16 has been pulled back to manually reset the fastener system 1.) The handle 16 also serves as a means for pushing the inner tubular member 8 forward in the outer tubular member 5 and, thus, pushing the sliding guide 17 forward toward the outward circular protrusion 39 of the ejector housing 13. With the sliding guide 17 being pushed forward toward the outward circular protrusion 39 of the ejector housing 13, the reset spring 18 is compressed between the outward circular protrusion 39 of the ejector housing 13 and the main body 37 of the sliding guide 17. While the fastener system 1 is in a firing mode, the reset spring 18 remains compressed. After the firing mode is completed, when the handle 16 is pulled backwards, the reset spring 18 expands as the sliding guide 17 moves towards the back end 2 of the fastener system 1, leading to the locking of the front section 35 of the firing rod 12 by the pin means 19 (i.e. putting the pin means 19, which preferably consists of pins or pin rings, in a locked position to lock the firing rod 12). (Yet, it should be noted that the handle 16 has to be pulled backward to reset the fastener system 1 to its original position before the handle 16 had been pushed forwards.) The forward spring 14 encloses the retaining section 11 of the reciprocable ejector 41 that is in the inner tubular member 8.

No matter what position the reciprocable ejector 41 is in and no matter what condition the fastener system 1 is at, the retaining section 11 and the outward circular protrusion 42 of the reciprocable ejector 41 are prevented by the inward circular protrusion 45 of the inner tubular member 8 from sliding out of the inner tubular member 8 and the inner tubular member 8 is prevented by the inward circular protrusion 46 of the cap 6 from sliding out of the outer tubular member 5. The outward circular protrusion 42 of the reciprocable ejector 41 is blocked by the inward circular protrusion 45 of the inner tubular member 8 when the handle 16 is pushed forward. The outward circular protrusion 44 of the inner tubular member 8 is blocked by the inward circular protrusion 46 of the cap 6 when the handle 16 is pulled backward.

In comparison, when the fastener system 1 is being manually reset, with the reset spring 18 opening up, the sliding guide 17 is pushed by the reset spring 18 to move towards the back end 2 but is prevented by the pin means 19 from sliding any further than a set limit towards the back end 2 of the fastener system 1. Although the pin means 19 is forced by the front part 38 of the sliding guide 17 into the number of perforations 40 and although, with the front section 35 of the firing rod 12 being positioned under the number of perforations 40, the pin means 19 is free to move inwards in the number of perforations 40, there is a limitation on the inward penetration of the pin means 19 into the ejector housing 13. The pin means 19 is stopped by the front section 35 of the firing rod 12 from radially penetrating beyond a certain limit into the back section 34 of the ejector housing 13. Therefore, a portion of the pin means 19 always protrudes outward of the ejector housing 13 and serves to block the passage of the sliding guide 17 towards the back end 2 of the fastener system 1. However, when the fastener system 1 is being manually reset, the portion of the pin means 19 that protrudes outward of the ejector housing 13 is shorter than the inner diameter of the main body 37 and of the front part 38 of the sliding guide 17, but overlaps with the inward circular protrusion 87 of the front part 38 of the sliding guide 17. The protruding portion of the pin means 19 prevents any further movement of the sliding guide 17 toward the back end 2 of the fastener system 1 when the inward circular protrusion 87 of the sliding guide 17 reaches the pin means 19 (i.e. the protruding portion of the pin means 19 prevents further backward retrieval of the inward circular protrusion 87 of the sliding guide 17). On the other hand, when the fastener system 1 is pushed forward and the main body 37 of the sliding guide 17 overlies the pin means 19 and the number of perforations 40, with the main body 37 of the sliding guide 17 being larger in inner diameter than the front part 38 of the sliding guide 17, additional free space is provided for the pin means 19 to move into such that the pin means 19 protrudes farther outward of the number of perforations 40 to reach the main body 37. With the main body 37 of the sliding guide 17 being of a larger inner diameter than the front part 38 of the sliding guide 17 and with the protruding portion of the pin means 19 extending up to the main body 37 of the sliding guide 17, the protruding portion of the pin means 19 prevents backward movement of the front part 38 of the sliding guide 17.

Before the handle 16 is pushed, the reset spring 18 is not compressed (while the forward spring 14 is open as well) and holds the sliding guide 17 in locked position (i.e. the front part 38 of the sliding guide 17 is above the number of perforations 40 in the ejector housing 13). (Please refer to FIG. 3A.) As soon as the handle 16 is pushed, the forward spring 14 is compressed and the inner tubular member 8 is forced to move towards the front end 3 of the fastener system 1. The inner tubular member 8 forcefully strikes the sliding guide 17 which, as a result, moves forward. With the reset spring 18 being positioned between the sliding guide 17 and the outward circular protrusion 39 of the ejector housing 13, the reset spring 18 becomes compressed and the main body 37 of the sliding guide 17 becomes positioned above the pin means 19. Thus, when the reset spring 18 becomes compressed, the pin means 19 unlocks. While the pin means 19 unlocks, the compressed forward spring 14 is allowed to open up and forces the firing rod 12 of the reciprocable ejector 41 to move forward in the tube 31 of the ejector housing 13 and the back section 34 of the ejector housing 13 to slide backward onto and against the inward circular protrusion 45 of the inner tubular member 8. In another preferred embodiment, a portion of the back section 34 of the ejector housing 13 slides backward into the inner tubular member 8 in order to provide increased stability for forward sliding of the reciprocable ejector 41 in the ejector housing 13. (Please refer to FIGS. 3B and 3C.)

The forward movement of the inner tubular member 8 causes the sliding guide 17 to move forward and results in compression of the reset spring 18 by the main body 37 of the sliding guide 17. (Please refer to FIG. 3C.) Before the main body 37 of the sliding guide 17 moves forward over the number of perforations 40 in the back section 34 of the ejector housing 13, the front part 38 of the sliding guide 17 overlies the number of perforations 40 and, therefore, the pin means 19. It should be noted that the inward circular protrusion 87 of the front part 38 of the sliding guide 17 has an inner diameter that is slightly larger than the outer diameter of the back section 34 of the ejector housing 13, allowing the inward circular protrusion 87 of the front part 38 of the sliding guide 17 to slide upon the back section 34 of the ejector housing 13. (Please refer to FIGS. 3A and 3B.) With basically no free space existing between the front part 38 of the sliding guide 17 and the pin means 19 and with no free space existing between the pin means 19 and the front section 35 of the firing rod 12 of the reciprocable ejector 41, the pin means 19 is held in the number of perforations 40 in the back section 34 of the ejector housing 13 until the front part 38 of the sliding guide 17 is slid forward from over the number of perforations 40 to allow some free space for outward movement of the pin means 19. When the front part 38 of the sliding guide 17 overlies the pin means 19, the pin means 19 moves centerwards and protrudes inwardly into the ejector housing 13. Thus, the pin means 19 intimately surrounds and locks the front section 35 of the firing rod 12 of the reciprocable ejector 41. When the front section 35 of the firing rod 12 is locked, with both the middle section 65 and the back section 36 of the fig rod 12 being larger in diameter than the front section 35, passage of the middle section 65 and the back section 36 is prevented. In a preferred embodiment, with the front section 35 of the firing rod 12 having a slightly smaller outer diameter than inner diameter of the front section 32 of the ejector housing 13 and with the front section 35 of the firing rod 12 being longer than distance between number of perforations 40 and top of the middle section 33 of the ejector housing 13, a portion of the front section 35 of the firing rod 12 rests in the front section 32 of the ejector housing 13 at all times even when the firing rod 12 is locked by the pin means 19. With the middle section 65 of the firing rod 12 having a slightly smaller outer diameter than inner diameter of the middle section 33 of and back section 34 of the ejector housing 13 and with the back section 36 of the firing rod 12 having a slightly smaller outer diameter than inner diameter of the middle section 33 of and back section 34 of the ejector housing 13, the middle section 65 of the firing rod 12 and a portion of the back section 36 of the firing rod 12 rest in the back section 34 of the ejector housing 13 while the firing rod 12 is locked by the pin means 19.

With the main body 37 of the sliding guide 17 being of a larger inner diameter than the front part 38 of the sliding guide 17, the pin means 19 is provided with additional free space to move outwards from within the ejector housing 13 and to, thus, unlock when the main body 37 of the sliding guide 17 overlies the pin means 19. When the main body 37 of the sliding guide 17 overlies the number of perforations 40 in the back section 34 of the ejector housing 13, the pin means 19 is provided with additional free space to move outwards and, thus, unlocks. A portion of the pin means 19 protrudes into the free space between the main body 37 of the sliding guide 17 and the ejector housing 13. With the middle section 65 of the firing rod 12 that neighbors the pin means 19 prior to and during unlocking of the pin means 19 being curved or slanted, an exertion of force upon the pin means 19 by the middle section 65 of the firing rod 12 in a horizontal direction (i.e. X-axis) directed toward the front end 3 of the fastener system 1, results in an upward movement of the pin means 19 in a vertical direction (i.e. Y-axis). Meanwhile, the front section 35 of the firing rod 12 of the reciprocable ejector 41 is freed to move forward as soon as the pin means 19 unlocks. The front section 35 of the firing rod 12 reaches front of the front section 32 of the ejector housing 13. The middle section 65 and a portion of the back section 36 of the firing rod 12 enter and fit tightly within the middle section 33 of the ejector housing 13. A portion of the back section 36 of the firing rod 12 moves forward through the open bottom 50 of the tube 31 of the ejector housing 13 and enters the middle section 33 of the ejector housing 13 upon passing by the opened up pin means 19 in the number of perforations 40 in the back section 34 of the ejector housing 13. With a portion of the back section 36 of the firing rod 12 fitting tightly within the middle section 33 and with another portion of the back section 36 of the firing rod 12 fitting tightly within the back section 34 of the ejector housing 13, the pin means 19 is prevented from inward movement into the ejector housing 13 and protrudes outwardly of the number of perforations 40 in the back section 34 of the ejector housing 13. A portion of the pin means 19 protrudes out of the number of perforations 40 into the free space under the main body 37 of the sliding guide 17. Any forward movement of the sliding guide 17 is limited by the outward circular protrusion 39 of the ejector housing 13, while any backward movement of the sliding guide 17 is limited by the pin means 19. Thus, any longitudinal movement of the sliding guide 17 is constrained between the outward circular protrusion 39 of the ejector housing 13 and the pin means 19. The pin means 19 and the firing rod 12 are unlocked and the firing rod 12 moves forward in the ejector housing 13. The firing rod 12 strikes from behind the closed top 49 of the tube 31 of the ejector housing 13 and bottom of the firing pin 20 of the ejector housing 13, initiating deflagration or detonation of a solid propellant pill. As a result, the forward spring 14 indirectly serves to force the ejector housing 13 and the sliding guide 17 forward and through the outer tubular member 5 and toward the barrel member 7. Obviously, the movement of the sliding guide 17 and of the ejector housing 13 affect the positioning and compression stage of the reset spring 18.

Therefore, a simple push on the handle 16 results, whether directly or indirectly, in forward movement of several components, including the firing rod 12, of the fastener system 1. A pressure exerted by the front section 35 of the firing rod 12, which serves as a hammer or plunger, upon the ejector housing 13 impacts the firing pin 20 (which is positioned at front of and is a forward extension of the front section 32 of and the closed top 49 of the tube 31). Upon impact of a solid propellant pill by the firing pin 20, an exploding force is produced that can push a fastener into a work surface. The balancing spring 15 encloses the front section 32 and the middle section 33 of the ejector housing 13 that are in the outer tubular member 5, with the balancing spring 15 being positioned between the outward circular protrusion 39 of the ejector housing 13 and the barrel member 7. Although the balancing spring 15 is not a vital component in the fastener system 1, the balancing spring 15 plays an essential role in balancing the fastener system 1. It should be emphasized that the balancing spring 15 does not play any role in returning the fastener system 1 to its original position (i.e. position before firing of the fastener system 1). However, the balancing spring 15 plays an important role in returning the ejector housing 13 to its original position after deflagration or detonation. As the ejector housing 13 moves backwards, either a portion of the back section 34 of the ejector housing 13 moves into the inner tubular member 8 or the back section 34 of the ejector housing 13 moves onto and against the inward circular protrusion 45 of the inner tubular member 8.

Figure 3A:
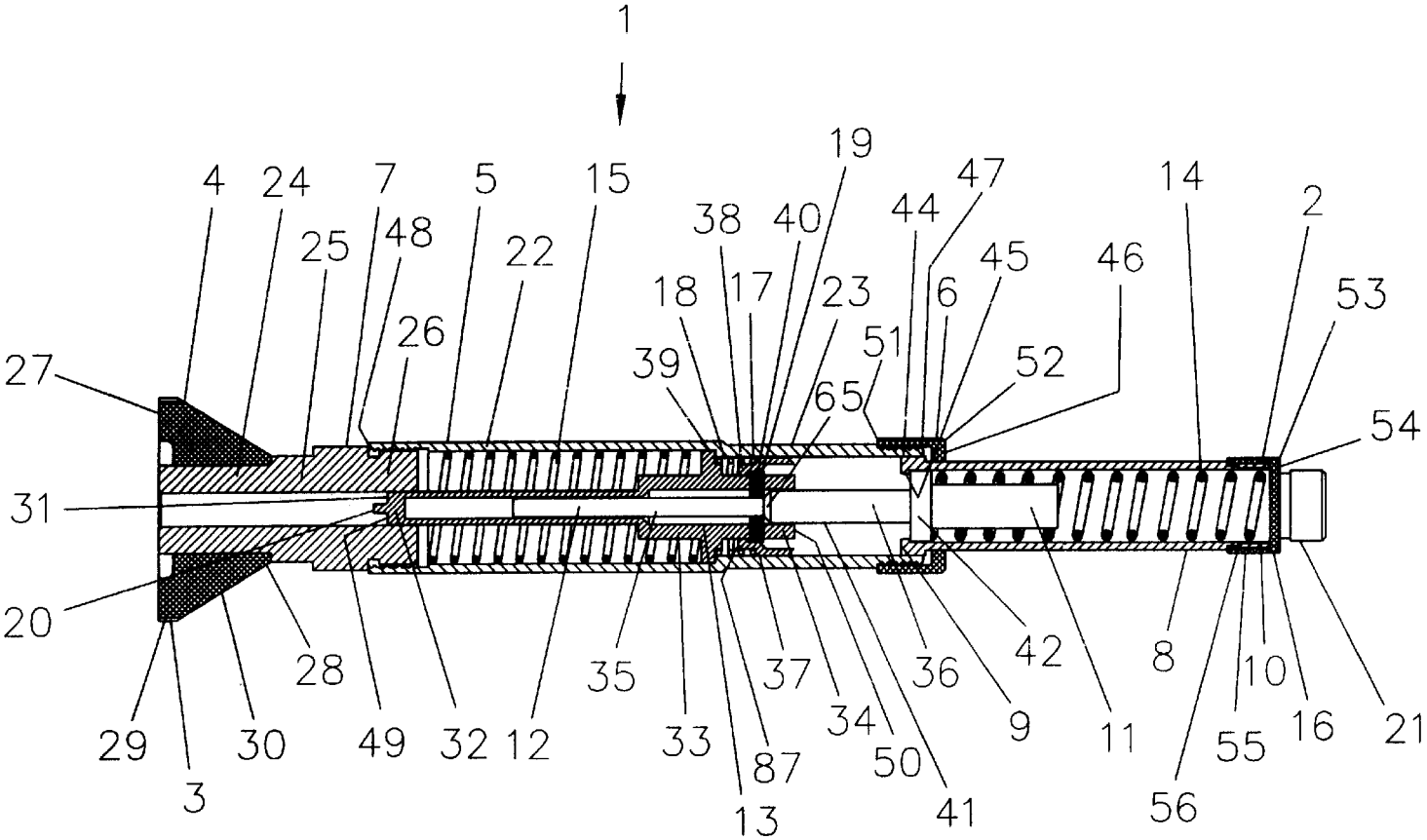
FIG. 3A is a horizontal cross-sectional view of the fastener system of FIG. 1 in set position before firing, with the fastener system having a firing rod and a pin means, when the firing rod is locked by the pin means.
Figure 3B:
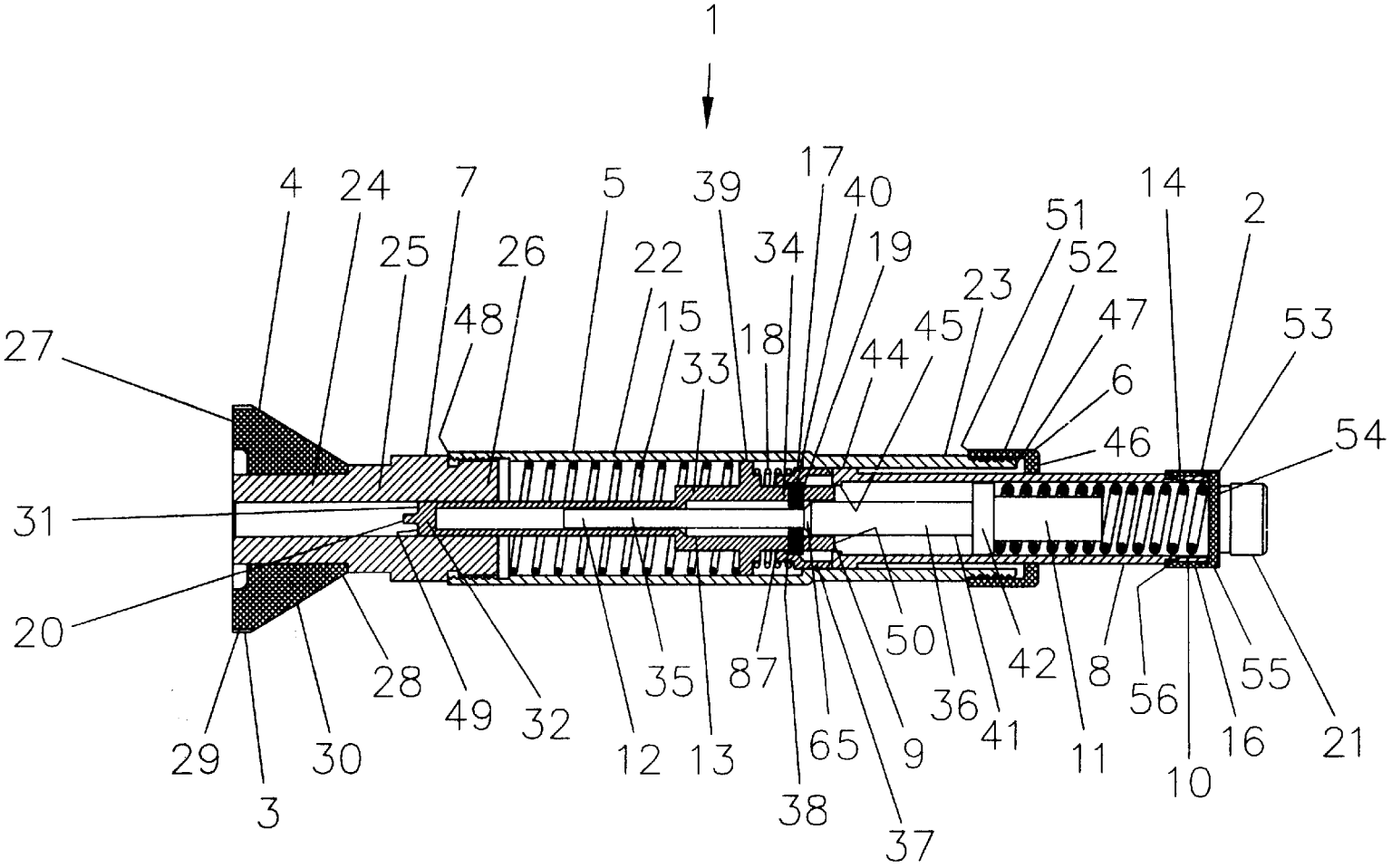
FIG. 3B is a horizontal cross-sectional view of the fastener system of FIG. 1 in set position during firing, with the fastener system having a handle and a pin means, immediately after the handle of the fastener system is pushed but before the pin means is unlocked.
Figure 3C:
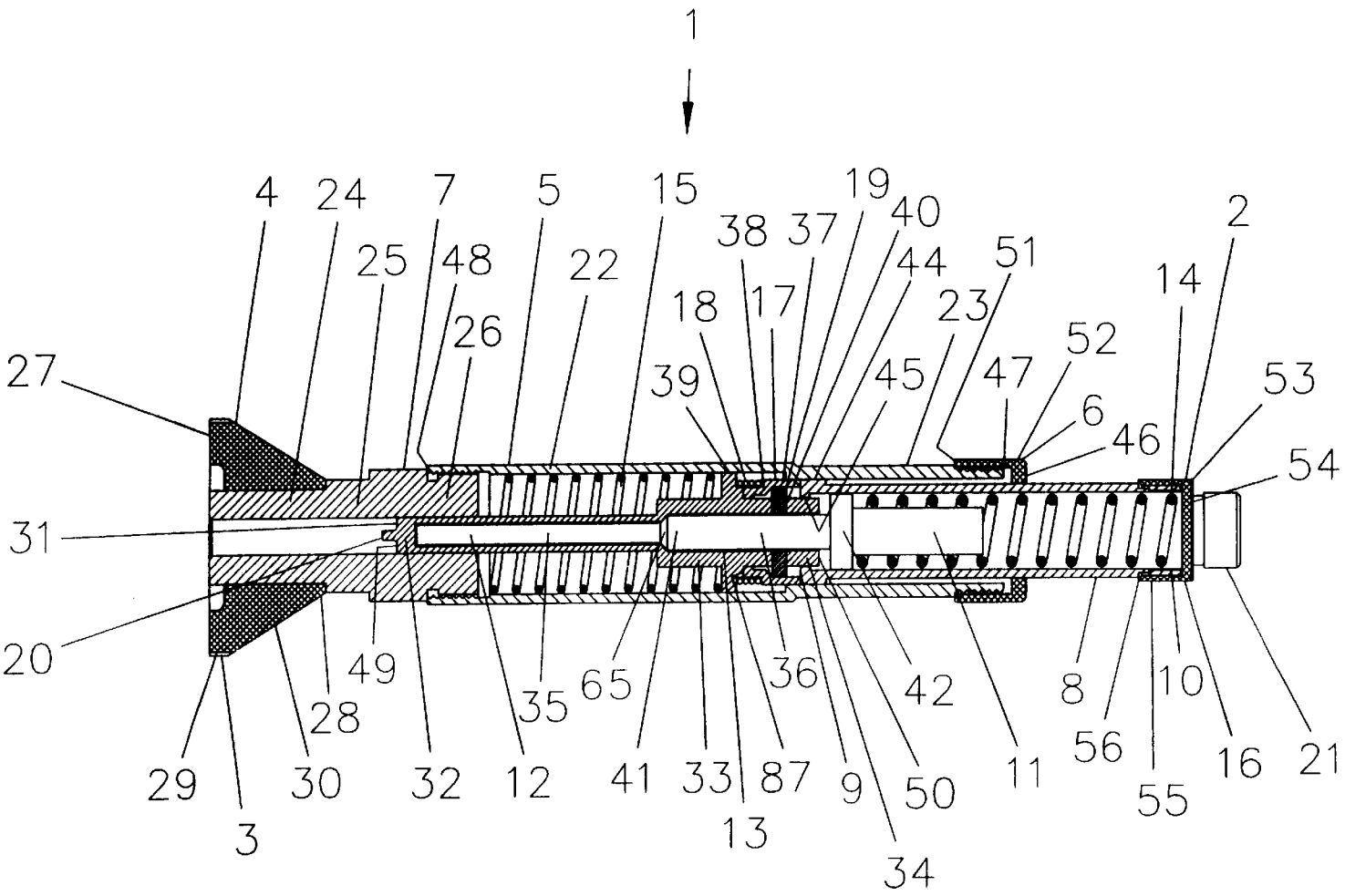
FIG. 3C is a horizontal cross-sectional view of the fastener system of FIG. 1, with the fastener system having a pin means, after firing and after the pin means is unlocked.

As discussed above, right in front of and adjacent to the front end 9 of the inner tubular member 8 are some of the most important features of the fastener system 1. As shown in FIGS. 3A, 3B and 3C, the sliding guide 17 provides a locking mechanism. But most importantly, the sliding guide 17 serves to return the fastener system 1 to its locked position before pushing of the handle 16 and firing of the solid propellant pill. The reset spring 18 is basically fitted around the front part 38 of the sliding guide 17. In a preferred embodiment, the reset spring 18 is positioned between the outward circular protrusion 39 of the ejector housing 13 and the main body 37 of the sliding guide 17. (Please refer to FIGS. 3A, 3B and 3C.) Since the reset spring 18 is positioned between the outward circular protrusion 39 of the ejector housing 13 and the main body 37 of the sliding guide 17, if the firing rod 12 of the reciprocable ejector 41 is kept in locked position, then the forward movement of the sliding guide 17 causes compression and exertion of pressure on the reset spring 18. When the handle 16 is pushed, the pressure exerted on the inner tubular member 8 results in forward movement of the sliding guide 17 and, thus, compression of and exertion of pressure on the reset spring 18. The pressure reserved in the reset spring 18 later contributes to a backward movement of the sliding guide 17 when the fastener system 1 is being manually reset. The reciprocable ejector 41 starts to move forward for firing a solid propellant pill. While the fastener system 1 is in a firing mode (i.e. the firing rod 12 is ready to move forward, is moving forward or has just hit the firing pin 20 of the ejector housing 13), the reset spring 18 remains compressed. (Please refer to FIG. 3C.) The reset spring 18 can be compressed to a certain level longitudinally. While the certain compression level is being reached, the sliding guide 17 is constrained against longitudinal movement by the pin means 19 and by the outward circular protrusion 39 of the ejector housing 13. After the firing mode is completed (i.e. the solid propellant pill is deflagrated or detonated and the fastener is fired) and when the fastener system 1 is manually reset, the reset spring 18 expands and, thus, pushes the sliding guide 17 backwards towards the back end 2 of the fastener system 1, resulting in locking of the pin means 19 however, with a portion of the pin means 19 protruding under the front part 38 of the sliding guide 17 and with the protruding portion of the pin means 19 overlapping with the inward circular protrusion 87 of the sliding guide 17, the protruding portion of the pin means 19 stops the inward circular protrusion 87, as well as other parts, of the sliding guide 17 from moving any further back.

When the inner tubular member 8 is moved forwardly longitudinally, a forward force is exerted on the sliding guide 17 by the inner tubular member 8. The retaining section 11 is slidably contained in the inner tubular member 8. The improved structure of the fastener system 1, with the reset spring 18, the pin means 19 and the sliding guide 17, provides a number of improvements, including a positive, precision positioning of the ejector housing 13 and, thus, the firing rod 12, in relation to the inner tubular member 8 and to the outer tubular member 5 when the fastener system 1 is being fired and during firing when holding the fastener system 1 against a work surface prior to and during firing until the firing application is completed.

In comparison, the pin means 19 is fitted in the number of perforations 40 in the back section 34 of the ejector housing 13. (Please refer to FIGS. 2, 3A, 3B and 3C.) The pin means 19 serves to lock the firing rod 12. When the firing rod 12 is locked by the pin means 19, the reciprocable ejector 41 is constrained against longitudinal movement. The pin means 19 plunges from the number of perforations 40 in the back section 34 of the ejector housing 13 into and towards the reciprocable ejector 41. (Please compare FIG. 3C with FIG. 3A.) Pulling of the handle 16 brings the front section 35, the middle section 65 and the back section 36 of the firing rod 12 backward. The front section 35 of the firing rod 12 slides backward in the front section 32 of the ejector housing 13 and enters the middle section 33 and the back section 34 of the ejector housing 13. In a preferred embodiment, an upper portion of the front section 35 of the firing rod 12 remains in the front section 32 of the ejector housing 13 while a lower portion of the front section 35 of the firing rod 12 rests in the middle section 33 and the back section 34 of the ejector housing 13. The firing rod 12 slides backward until the middle section 65 of the firing rod 12 clearly passes the number of perforations 40 that are positioned in the back section 34 of the ejector housing 13. When the front section 35 of the firing rod 12 underlies the number of perforations 40 and the pin means 19, due to the smaller diameter of the front section 35 of the firing rod 12, the pin means 19 is forced to move inward and, thus, a backward movement of the sliding guide 17 is unconstrained. When the handle 16 is pulled backwards, the reset spring 18 opens up and, as a result, the sliding guide 17 moves towards the back end 2 of the fastener system 1 and forces the pin means 19 into the number of perforations 40 upon the front section 35 of the firing rod 12. The pin means 19 is only locked when the reset spring 18 opens up sufficiently to push the sliding guide 17 far enough towards the back end 2 of the fastener system 1 to cause the plunging of the pin means 19 upon the front section 35 of the firing rod 12 of the reciprocable ejector 41. The freedom of the pin means 19 to move laterally does not effect the freedom of movement of the ejector housing 13. The ejector housing 13 is only constrained from movement when a fastener is being loaded. The movement of the ejector housing 13 enhances the distance traveled by the firing rod 12. When the ejector housing 13 moves longitudinally, the ejector housing 13 carries along and co-axially with itself the firing rod 12 which is slidably received in the tube 31 of the ejector housing 13. The movement of the firing rod 12 along with the ejector housing 13 is in addition to the movement of the firing rod 12 within the ejector housing 13 when the handle 16 is moved longitudinally, causing the pin means 19 to unlock and forcing the retaining section 11 of the reciprocable ejector 41 to move forward within the inner tubular member 8.

The ejector housing 13 is centered and guided by being slidable within the outer tubular member 5 and the barrel member 7. The ejector housing 13 is grooved for receiving the pin means 19. The ejector housing 13 actually acts as a sleeve for the firing rod 12. Therefore, in a preferred embodiment, the ejector housing 13 is particularly designed to correspond to shape and dimensions of the firing rod 12. The firing rod 12 is slidingly and reciprocatingly disposed within the ejector housing 13. In a preferred embodiment, the firing rod 12 has a larger diameter than the firing pin 20. (Please refer to FIGS. 3A, 3B and 3C.) The reciprocable ejector 41 is, in turn, slidingly and reciprocatingly disposed within the inner tubular member 8, the outer tubular member 5 and the barrel member 7. The firing pin 20 extends outwardly and forwardly from the front section 32 of and from the closed top 49 of the tube 31 of the ejector housing 13 and is co-axial with the firing rod 12. With the firing pin 20 extending forwardly from the closed top 49 of the tube 31, when the ejector housing 13 is positioned in the outer tubular member 5, the firing pin 20 is positioned in or adjacent to the axial, central bore of the barrel member 7 of the fastener system 1. The firing pin 20 is structured and designed to strike or engage the end of the solid propellant pill. The firing rod 12 and the firing pin 20 are particularly designed to increase the efficiency of igniting or deflagrating the power pill while maximizing the safety of application of the fastener system 1.

The outer tubular member 5 consists of a raised section 22 and a lower section 23. (Please refer to FIGS. 1, 2, 3A, 3B and 3C.) The cap 6 that is attached to the back end 47 of the outer tubular member 5, is attached to the lower section 23 farthest from the raised section 22. The raised section 22 extends between the barrel member 7 and the lower section 23. The lower section 23 extends between the raised section 22 and the inward circular protrusion 46 of the cap 6. Thus, the outer tubular member 5 extends between the barrel member 7 and the cap 6. The outward circular protrusion 39 of the ejector housing 13 is smaller in diameter than the raised section 22 of the outer tubular member 5, but is larger in diameter than the lower section 23 of the outer tubular member 5. As a result, the outward circular protrusion 39 of the ejector housing 13 moves longitudinally in the raised section 22 of the outer tubular member 5, but is blocked by the lower section 23 from receding any further. With the balancing spring 15 being positioned between the outward circular protrusion 39 of the ejector housing 13 and the barrel member 7, the raised section 22 of the outer tubular member 5 always encapsulates the balancing spring 15. The purpose of using the balancing spring 15 in the raised section 22 of the outer tubular member 5 is to maintain the fastener system 1 balanced. The balancing spring 15 prevents the ejector housing 13 from free dropping forwardly in the raised section 22 of the outer tubular member 5 and keeps the ejector housing 13 in balanced position. The lower section 23 of the outer tubular member 5 serves as a stopper for the ejector housing 13. The lower section 23 of the outer tubular member 5 has a diameter that is suited for sliding of the sliding guide 17 and of the inner tubular member 8. The lower section 23 of the outer tubular member 5 also serves as an entrance for the inner tubular member 8 and, thus, for the forward spring 14 during triggering of the fastener system 1.

The barrel member 7, comprising a front part 24, a middle part 25 and a back part 26, leads to the muzzle 4. (Please refer to FIGS. 2, 3A, 3B and 3C.) The muzzle 4 is the opening to the barrel member 7. The muzzle 4, the barrel member 7, the ejector housing 13, including the tube 31, the outward circular protrusion 39 and the firing pin 20, and the reciprocable ejector 41, including the firing rod 12, the outward circular protrusion 42 and the retaining section 11, are all co-axially aligned. The front part 24 of the barrel member 7 is surrounded by and is attached to the muzzle 4 and is inserted into an internal opening in the muzzle 4. The back part 26 of the barrel member 7 is inserted into the outer tubular member 5 to attach the barrel member 7 to the outer tubular member 5. The middle part 25 of the barrel member 7 connects the front part 24 to the back part 26 of the barrel member 7. In a preferred embodiment, the middle part 25 of the barrel member 7 includes arrangements in its design (e.g. as shown in FIG. 3A) to facilitate wrenching of the barrel member 7.

The muzzle 4 comprises a front end 27 and a back end 28. (Please refer to FIGS. 1, 2, 3A, 3B and 3C.) In a preferred embodiment, the muzzle 4 has a substantially frustoconical shape and comprises a cylindrical portion 29 adjacent to the front end 27 and a conical portion 30 adjacent to the back end 28. The cylindrical portion 29 of the muzzle 4 establishes a relatively wide support surface at the front part 24 of the barrel member 7 and extends backwardly into the conical portion 30. The front end 27 of the muzzle 4 is open for exit of the fastener at an end of the cylindrical portion 29 of the muzzle 4 in which the fastener is supported for its movement outwardly through and out of the front end 27 of the muzzle 4. A lower diameter of the back end 28 (when compared to the front end 27) of the muzzle 4 as provided by the frusto-conical shape of the muzzle 4 provides a more exact locating of the fastener into the work surface. In addition, the shape of the muzzle 4, in combination with the structure of the fastener system 1, serve to e spreading of spalls and of noise.

In use, the muzzle 4 is applied to guide the striking direction so as to prevent excess and/or misdirected penetration of the fastener. The muzzle 4 has a central bore, a portion of which is occupied by a part of the barrel member 7 and another portion of the central bore of the muzzle 4 remains empty. (Please refer to FIGS. 1, 3A, 3B and 3C.) A portion of the central bore of the muzzle 4 is occupied by a part of the barrel member 7. Another portion of the central bore of the muzzle 4 that is positioned in the cylindrical portion 29 of the muzzle 4 remains empty and serves as a circular recess. Therefore, the front end of the fastener system 1 comprises a central bore first encircled by a raised internal section, then by a circular recess and then by a raised circular enclosure that has a number of cuts on its edge for pinpointing the fastener.

The fastener system 1 is adapted to receive the fastener and the solid propellant pill via the front end of the muzzle 4, with the fastener and the solid propellant pill being positioned against the firing pin 20 of the ejector housing 13. If the fastener system 1 is placed against a work surface, the fastener faces the work surface and is followed by the solid propellant pill and the firing pin 20. The firing pin 20, serving as the extension of the ejector housing 13, is adapted to be driven against and ignite the solid propellant pill by striking the solid propellant pill. The energy of the propellant in the solid propellant pill is transmitted to the fastener and propels the fastener into the work surface. Fasteners of different lengths and shapes can be used.

Numerous versions of solid propellant pills (not shown), consisting of various propellants and cases of different shapes, may be used with the present invention. The propellants may be made of any suitable material which will degnate or detonate in the barrel member 7 upon provision of a sufficiently strong impact on the solid propellant pill by the firing pin 20. In a preferred embodiment, the solid propellant pill (presented in a patent application filed by the applicant of the present invention on Nov. 10, 1997) comprises a case having a front end, an open back end and a tubular side wall that connects the front end to the open back end, one base being positioned between the front end and the open back end and having a front surface and a back surface, with a raised section that is centrally positioned on the back surface of the base and that faces the open back end, and a block of propellant being centrally positioned and balanced upon the raised section of and below the base and extending below the base. In one preferred embodiment (referred to as a "single open-ended solid propellant pill"), the case comprises an open back end, a closed front end and a tubular side wall extending between the open back end and the closed front end and being integral with the closed back end. The closed front end is positioned opposite to the open back end and both are preferably circular. A base is positioned between the open back end and the closed front end. The base has a front surface and a back surface. The front surface of the base serves as the closed front end of the case. A raised section is centrally positioned on the back surface of the base and faces the open back end. In another preferred embodiment of the case (referred to as a "double open-ended solid propellant pill"), the case comprises an open front end, an open back end and a tubular side wall extending between the open front end and the open back end. A base is positioned between the open front end and the open back end and has a front surface and a back surface. A raised section is centrally positioned on the base and faces the open back end. The base has a front surface that faces the open front end.

The solid propellant pill can only be viewed at the front end of the case. When using the fastener system 1, the physical and chemical properties, such as weight, shape, length, width, thickness and composition, of the solid propellant pill are designed to provide the user with a maximal control of the fastener. The properties of the solid propellant pill determine, among other features, the distance traveled by, the speed of, the power of and the depth of insertion of the fastener into the work piece. Increasing control over the solid propellant pill implies a higher degree of safety, simplicity and efficiency, lower noise levels and reduced work damages of application of the fastener system 1. Since various versions of solid propellant pills may be used with one fastener, the same fastener may be used safely and efficiently for a range of surfaces of different densities and compressive strengths. Meanwhile, one version of the solid propellant pill may be used for various versions of the fastener system 1 and for various versions of the fastener.

The fastener system 1 is selected to have the properties of high energy output. With the fastener system 1, propellant material is used that can be contained in a small volume and that will ignite by a high impulse, e.g. one pound second, and is sufficiently stable so as not to be ignited at a lower impulse or by friction such as might be encountered in mishandling of the firing pins or firing rods of a loaded fastener system 1. The propellant, which is a compactly solidified cake or block, comprises a booster charge (which is made up of compacted nitrocellulose fibers) and an explosive powder (which is referred to as "primary charge" and which is made up of stabilized nitrocellulose granules). The propellant is carried in a stable and solid case, with the case existing in various forms, compositions and coatings. The case may come in various forms including, but not limited to, tubes (optionally of thermoplastic resins) extending between a front end and a back end. The propellant is positioned inside the case, preferably between the open end and the closed end of the case. The case is neither prone to ignition by electrolytes nor by primers, but is ignited mechanically upon provision of sufficient friction using a firing rod. When sufficient friction is created, the propellant is ignited and the fastener is expelled.

Meanwhile, the booster charge and the primary charge are sufficiently compact and stable and are ignitable only at an energy that is higher than a minimal set limit such that ignition does not occur at a lower-than-intended friction level. By providing a unified, compact propellant, the ignition of the propellant is resisted up to a set limit at which point the ignition and burning of the propellant occurs basically instantaneously. Also, by providing a unified booster charge having an explosive capability that is a significant portion of the total explosive charge of the power load, it is found that the ignition and burning of the booster charge does occur simultaneously with the ignition and burning of the explosive powder.

The firing rod 12 of the reciprocable ejector 41 is propelled at a high speed to create an impulsive force on the firing pin 20 to detonate or deflagrate the solid propellant pill and to drive a fastener. The propellant is made of consumable or combustible material which is substantially entirely consumed or used up upon firing so that no portion of the propellant remains in the fastener system 1 after firing of the fastener system 1. The fastener system 1 is manually reset by pulling the handle 16 as far backward as possible before any remaining parts of the solid propellant pill are removed. An ejection arrangement is associated with the fastener system 1 for removing any spent explosive charges (i.e. any remaining parts of the solid propellant pill) that remain after ignition. An essential component of the ejection arrangement of the fastener system 1 is the firing pin 20 of the ejector housing 13 that is movable within the outer tubular member 5 and the axial, central bore of the barrel member 7 when the forward spring 14 moves between a retracted position and an extended position. In addition, a stabilizer may be used in the propellant to control the ignition of the propellant and to assure a substantial shelf-life for the propellant.

Importantly, the construction of the solid propellant pill is provided to assure safe activation of the propellant. A major goal of the present invention is to assure that the propellant does not ignite as a result of mishandling of the solid propellant pill. It is necessary for the case of the solid propellant pill to have sufficient strength to remain intact when being transferred. Accordingly, by using the solid propellant pill, a safety feature may be built into the fastener system 1 to more accurately control a fastener which is adapted to be driven into a dense material, such as concrete, and to prevent the fastener from being driven through a material of less density, such as thin metal, and from causing personal injury and property damage.

Meanwhile, upon ignition of the propellant, pieces of elements holding or containing the propellant should not remain in the fastener system 1. Tools capable of safely handling such propellants become more complicated, more expensive and subject to greater control as the peak explosive pressure of the propellants becomes higher. By having a base with a raised section on a front surface and a raised section on a back surface, a smaller area of the solid propellant pill comes into contact with the fastener and with the propellant, respectively. Since pressure is the ratio of force to area, pressure is inversely proportional to area. Therefore, under equal amounts of force, the smaller the area of contact of the solid propellant pill is with the fastener, the larger is the pressure exerted on the fastener by the solid propellant pill. The distance traveled by, the speed of, the power of and the depth of insertion of the fastener into the work piece are all effected by and are directly proportional to the amount of pressure exerted on the fastener. Thus, if the application of a set amount of force yields an increase in pressure, the efficiency of performance of the fastener system 1 is increased.

The fastener system 1 may be made of any suitable material as known in the art. Typically the reciprocable ejector 41 is made of type S7 tool steel. Other parts of the fastener system 1 are usually made of type 4140 tool steel and the barrel member 7 is made of compression pipe stainless steel. The handle 16 is made of aluminum or fiberglass. The fastener is made of type 1062 wire.

This patent is also intended to protect the method of application of the improved explosively actuated fastener system 1 which is used to drive a fastener into a work piece. In application of the fastener system 1, the handle 16 is first pulled backward to manually reset the fastener system 1. Any remaining part of a solid propellant pill from a previous application of the fastener system 1 (with the solid propellant pill having its propellant consumed during the previous application) is removed by exerting force on the ejector housing 13 from behind. A solid propellant pill is then positioned in front of the firing pin 20 and in the axial, central bore of the barrel member 7. Next, a fastener is placed in front of the solid propellant pill, with the fastener being adjusted against and pointing away from the solid propellant pill and headed towards a work surface. The muzzle 4 is directed towards and placed against the work surface by holding the fastener system 1, via its handle 16, in that direction. When the fastener system 1 is positioned at the desired location, the handle 16 is pushed.

After deflagration or detonation, the balancing spring 15, which has been compressed when the handle 16 was pushed, expands and returns the ejector housing 13 towards the back end 2 of the fastener system 1. The fastener system 1 is actuated by pushing the handle 16 after the balancing spring 15 expands, such that the pin means 19 is unlocked and the firing rod 12 strikes the firing pin 20 of the ejector housing 13. When the firing rod 12 strikes the firing pin 20 of the ejector housing 13, the firing pin 20 is impacted strongly enough to initiate deflagration or detonation in the solid propellant of the solid propellant pill.

FIG. 3A shows a horizontal cross-sectional view of the fastener system 1 in a manually reset position before firing when the firing rod 12 is locked by the pin means 19. When the fastener system 1 is manually reset to be fired and the handle 16 has not yet been pushed, the outward circular protrusion 42 of the reciprocable ejector 41 is farther from the handle 16 and, thus, closer to the front end 9 of the inner tubular member 8 than after the handle 16 has been pushed. Also, before the handle 16 is pushed, in a preferred embodiment, the handle 16 is pulled as far backwards as possible such that the front end 9 of the inner tubular member 8 is positioned adjacent to the cap 6 that is attached to the outer tubular member 5. When the handle 16 is pulled backward, the inward circular protrusion 46 of the back end 52 of the cap 6 prevents the exit of the inner tubular member 8, with the outward circular protrusion 44 of the inner tubular member 8 being larger in diameter than the inward circular protrusion 46 of the cap 6, from the outer tubular member 5. In addition, before the handle 6 is pushed, the outward circular protrusion 42 of the reciprocable ejector 41 rests adjacent to the front end 9 of the inner tubular member 8, being stopped by the inward circular protrusion 45 of the inner tubular member 8, and the forward spring 14 remains open. It is only after the handle 16 is pushed forward that the forward spring 14 becomes compressed. Meanwhile, the front section 35 of the firing rod 12 of the reciprocable ejector 41 is locked in position by the pin means 19 and some empty space exists between top of the firing rod 12 and the closed top 49 of the tube 31 of the ejector housing 13 (i.e. between top of the firing rod 12 and bottom of the firing pin 20). In addition, some distance exists between the sliding guide 17 and the inner tubular member 8 and between the ejector housing 13 and the inner tubular member 8. Also, the handle 16, particularly the closed bottom 54 of the base 53 of the handle 16, prevents the exit of the forward spring 14 from the inner tubular member 8 when the handle 16 is pulled backward.

FIG. 3B demonstrates a horizontal cross-sectional view of the fastener system 1 in a manually reset position during firing, immediately after the handle 16 of the fastener system 1 is pushed but before the pin means 19 is urnocked. When the handle 16 is pushed forward, the inner tubular member 8 is moved forwardly longitudinally. However, the outward circular protrusion 42 and the retaining section 11 of the reciprocable ejector 41 that are sridably contained in the inner tubular member 8 do not move forwardly at the same rate as the inner tubular member 8 does and, therefore, there is a relative backward movement or penetration of the reciprocable ejector 41 into the inner tubular member 8. As the reciprocable ejector 41 moves relatively backwards when the handle 16 is pushed, the outward circular protrusion 42 of the reciprocable ejector 41 approaches the back end 10 of the inner tubular member 8 and the handle 16, causing compression of the forward spring 14 between the outward circular protrusion 42 of the reciprocable ejector 41 and the handle 16, and eventually and simultaneously the back section 36 of the firing rod 12 of the reciprocable ejector 41 penetrates into the inner tubular member 8 as well. In FIG. 3B, the front section 35 of the firing rod 12 of the reciprocable ejector 41 is still locked in position by the pin means 19 and, thus, some empty space exists between top of the firing rod 12 and the closed top 49 of the tube 31 of the ejector housing 13 (i.e. between bottom of the firing pin 20 and top of the firing rod 12). However, FIG. 3B demonstrates a stage of firing Immediately before release of the pin means 19 when basically no distance exists between the sliding guide 17 and the inner tubular member 8 and between the ejector housing 13 and the inner tubular member 8. Meanwhile, the handle 16, particularly the closed bottom 54 of the base 53 of the handle 16, prevents the exit of the forward spring 14 from the inner tubular member 8 while the handle 16 is being pushed forward. The inner tubular member 8, particularly the outward circular protrusion 44 of the inner tubular member 8, pushes the sliding guide 17 forward when the handle 16 is being pushed forward.

FIG. 3C is a horizontal cross-sectional view of the fastener system 1 after firing and after the pin means 19 is unlocked and the firing rod 12 strikes bottom of the firing pin 20. When the handle 16 is pushed and upon unlocking of the pin means 19, the forward spring 14 opens up. Upon opening up, the forward spring 14 pushes the reciprocable ejector 41, including the firing rod 12, forward. However, the retaining section 11 and the outward circular protrusion 42 of the reciprocable ejector 41 are prevented from exiting the inner tubular member 8 since the outward circular protrusion 42 of the reciprocable ejector 41 is larger in diameter than the inward circular protrusion 45 of the inner tubular member 8. Even though the forward spring 14 pushes the reciprocable ejector 41 forcefully forward, the outward circular protrusion 42 of the reciprocable ejector 41 is prevented from exiting the inner tubular member 8 by the inward circular protrusion 45 of the inner tubular member 8. Despite this halt on the outward circular protrusion 42 of the reciprocable ejector 41, the firing rod 12 of the reciprocable ejector 41 strikes bottom of the firing pin 20. When top of the firing rod 12 strikes bottom of the firing pin 20, the outward circular protrusion 42 of the reciprocable ejector 41 has been stopped by the inward circular protrusion 45 of the inner tubular member 8 and the forward spring 14 has opened up. In FIG. 3C, no empty space exists between top of the firing rod 12 of the reciprocable ejector 41 and closed top 49 of the tube 31 of the ejector housing 13. FIG. 3C demonstrates a stage of firing after release of the pin means 19 during firing of the solid propellant pill. As is immediately before release of the pin means 19, basically no distance exists in FIG. 3C between the sliding guide 17 and the inner tubular member 8 and between the ejector housing 13 and the inner tubular member 8 during firing of the solid propellant pill. The handle 16 is prevented from entering into the outer tubular member 5 by the inward circular protrusion 46 at the back end 52 of the cap 6. With the base 53 of the handle 16 being larger in diameter than the inward circular protrusion 46 of the cap 6, the handle 16 is prevented from entering into the outer tubular member 5. With a portion of the inner tubular member 8 at the back end 10 being attached to and covered by the handle 16, the portion of the inner tubular member 8 at the back end 10 always remains outside of and does not enter the outer tubular member 8 while being capped by the handle 16. The portion of the inner tubular member 8 at the back end 10 covered by the handle 16 and the handle 16 are rebound when the handle 16, particularly the front edge 56 of the tubular side wall 55 of the base 53 of the handle 16, strikes the inward circular protrusion 46 of the cap 6.

When pressure is exerted by using the handle 16, the forward spring 14 serves to force the retainlng section 11 of the reciprocable ejector 41 forward in the inner tubular member 8. However, with the outward circular protrusion 42 of the reciprocable ejector 41 being larger in diameter than the retaining section 11 and with the inward circular protrusion 45 of the inner tubular member 8 being smaller in diameter than the outward circular protrusion 42 of the reciprocable ejector 41, the exit of the retaining section 11 and of the outward circular protrusion 42, which is in front of the retaining section 11, of the reciprocable ejector 41 from the inner tubular member 8 is prevented. With the reciprocable ejector 41 having a basically longitudinal cylindrical body, the forward movement of the retaining section 11 implies a forward movement of the firing rod 12, and vice versa. Upon being unlocked by the pin means 19, the reciprocable ejector 41 is centered and guided by being slidable within the inner tubular member 8 and the ejector housing 13. However, the retaining section 11 of and the outward circular protrusion 42 of the reciprocable ejector 41 always remain in the inner tubular member 8, the front section 35 of the firing rod 12 of the reciprocable ejector 41 always remains in the ejector housing 13, the middle section 65 of the firing rod 12 moves between the middle section 33 of and the back section 34 of the tube 31 of the ejector housing 13 and the back section 36 of the firing rod 12 of the reciprocable ejector 41 moves back and forth between the inner tubular member 8 and the middle section 33 and the back section 34 of the tube 31 of the ejector housing 13.

In a preferred embodiment, a manual resetting of the inner tubular member 8, and thereby of the reciprocable ejector 41 including the firing rod 12, is performed after the balancing spring 15 expands and before pushing the handle 16. In the manual resetting of the inner tubular member 8, and thereby of the reciprocable ejector 41 (including the firing rod 12), the handle 16 and, thus, the inner tubular member 8 and the reciprocable ejector 41 (including the firing rod 12) are moved backwards such that the back section 36 of the firing rod 12 moves out of the middle section 33 of the ejector housing 13, such that a portion of the front section 35 of the firing rod 12 moves backward into the middle section 33 of and the back section 34 of the tube 31 of the ejector housing 13 and such that the middle section 65 of the firing rod 12 moves immediately behind the pin means 19 but remains in the back section 34 of the tube 31 of the ejector housing 13. With the pin means 19 being forced to move inward when the front section 35 of the firing rod 12 underlies the number of perforations 40 and provides additional free space for insertion of the pin means 19, backward movement of the sliding guide 17 is unconstrained. Meanwhile, when the firing mode is completed (i.e. the solid propellant pill is deflagrated or detonated and the fastener is fired), the reset spring 18 expands and, therefore, pushes the sliding guide 17 backwards towards the back end 2 of the fastener system 1. As the main body 37 of the sliding guide 17, which has a larger diameter than the front part 38 of the sliding guide 17, moves backwards and the front part 38 of the sliding guide 17 overlies the pin means 19, the pin means 19 is forced through the number of perforations 40 in the back section 34 of the ejector housing 13 into the ejector housing 13 and, thus, locks the front section 35 of the firing rod 12. The locking of the front section 35 of the firing rod 12 by the pin means 19 prevents any forward movement of the reciprocable ejector 41 (i.e. locks the reciprocable ejector 41 from sliding into the ejector housing 13). When the handle 16 is pulled, the sliding guide 17 returns to its original locked position, such that the reset spring 18 opens up as the sliding guide 17 moves towards the back end 2 of the fastener system 1. The pin means 19 is only locked when the reset spring 18 opens up sufficiently to push the sliding guide 17 far enough towards the back end 2 of the fastener system 1 to cause the plunging of the pin means 19 upon the front section 35 of the firing rod 12. The pressure reserved in the reset spring 18 contributes to movement of the sliding guide 17 backwards. The firing rod 12 is manually reset in a locked position before the handle 16 is pushed forward and before the handle 16, in retroaction, pushes the reciprocable ejector 41 forward. In the manual resetting of the inner tubular member 8, and thereby of the reciprocable ejector 41 (including the firing rod 12), when the handle 16 is pulled backwards, a return of the handle 16 towards the back end 2 of the fastener system 1 results in backward movement of the reciprocable ejector 41 which serves to force the forward spring 14 toward the handle 16 at the back end 10 of the inner tubular member 8. The inner tubular member 8 is prevented from exiting the cap 6 despite the backward movement of the handle 16 and the open end of the cap 6. The outward circular protrusion 44 of the inner tubular member 8 is larger in diameter than the inward circular protrusion 46 of the cap 6 and, therefore, the inner tubular member 8 is prevented from completely exiting the outer tubular member 8 when the handle 16 is pulled backward. When the handle 16 is pulled completely backward, the outward circular protrusion 44 of the inner tubular member 8 is blocked by the inward circular protrusion 46 of the cap 6. When the reciprocable ejector 41 moves backward in the inner tubular member 8, the forward spring 14 is compressed between the outward circular protrusion 42 of the reciprocable ejector 41 and the closed bottom 54 of the base 53 of the handle 16 at the back end 10 of the inner tubular member 8. The inner tubular member 8 is urged to eventually slide away from and out of the outer tubular member 5, but is prevented from exiting the outer tubular member 5 by the blockage of the outward circular protrusion 44 of the inner tubular member 8 by the inner circular protrusion 46 of the cap 6. The fastener system 1 is fired simply by pushing the handle 16 forward, thereby enabling the forward spring 14 in the inner tubular member 8 to expand.

When the handle 16 is pushed forward, the forward spring 14 expands and a striking force is built up witn the inner tubular member 8 that forces the reciprocable ejector 41 and the inner tubular member 8 to move forward towards the front end 3 of the fastener system 1. Meanwhile, the sliding guide 17 is pushed forward by the inner tubular member 8 when the inner tubular member 8 is pushed towards the front end 3 of the fastener system 1. As a result, with the main body 37 of the sliding guide 17 being larger in inner diameter than the front part 38 of the sliding guide 17, when the sliding guide 17 moves forward, the pin means 19 is provided with additional free space to be forced to move outwards from within the ejector housing 13 and to, thus, unlock when the main body 37 of the sliding guide 17 overlies the pin means 19 and the number of perforations 40. The retaining section 11 of the reciprocable ejector 41 moves forward in the inner tubular member 8 while the pin means 19 is unlocked and while the firing rod 12 moves forward in the tube 31 of the ejector housing 13. The front section 35 of the firing rod 12 is freed to move forward as soon as the pin means 19 is unlocked. The middle section 65 of the firing rod 12 exerts upon the pin means 19 a horizontal force directed toward the front end 3 of the fastener system 1, resulting in an upward, vertical movement of the pin means 19. The front section 35 of the firing rod 12 reaches front of the front section 32 of the ejector housing 13. The middle section 65 of and a portion of the back section 36 of the firing rod 12 enter the middle section 33 of the ejector housing 13 upon passing by the unlocked pin means 19 in the number of perforations 40 in the back section 34 of the ejector housing 13. Meanwhile, while the pin means 19 is unlocked and while the front section 35 of the firing rod 12 moves forward in the front section 32 of the tube 31 of the ejector housing 13, either a portion of the back section 34 of the ejector housing 13 slides backward into the inner tubular member 8 or the back section 34 of the ejector housing 13 moves onto and against the inward circular protrusion 45 of the inner tubular member 8. In addition, when the inner tubular member 8 is moved forward upon pushing the handle 16, the sliding guide 17 is forced to move forward when hit by the inner tubular member 8 and the reset spring 18 is compressed by the sliding guide 17 until a maximum compression level of and pressure exertion on the reset spring 18 is reached, with the reset spring 18 being compressed between the man body 37 of the sliding guide 17 and the outward circular protrusion 39 of the ejector housing 13. Therefore, as soon as the handle 16 is pushed, the forward spring 14 is compressed (and then opens up) and the reset spring 18 becomes compressed, resulting in build-up of the striking force that forces the reciprocable ejector 41 and the inner tubular member 8 to move towards the front end 3 of the fastener system 1 and allowing unlocking of the pin means 19. Thus, the firing rod 12 moves forward in the ejector housing 13 and strikes the firing pin 20 of the ejector housing 13, initiating deflagration or detonation of the solid propellant pill.

After deflagration or detonation of the solid propellant pill, the propellant (which is carried in a plastic case) is entirely consumed, but the plastic case remains in the fastener system 1. However, the plastic case can be easily removed from the fastener system 1. This procedure does not rely upon raising temperature by precompression of air about the solid propellant pill. Rather, this procedure for removing the plastic case requires some "relative motion" in the fastener system 1. After degnation or detonation of the solid propellant pill and manual resetting of the fastener system 1, the plastic case is ejected either by pushing the handle 16 or by holding the handle 16 and by pushing the outer tubular member 5 and the barrel member 7 backwards. Upon pushing the handle 16 or upon holding the handle 16 and pushing the outer tubular member 5 and the barrel member 7 backwards, the ejector housing 13 is in either case pushed forward 13 (i.e. "relative motion") and the plastic case is pushed out of the fastener system 1. The front end 3 of the fastener system 1 is designed slightly larger than the plastic case to allow simple loading of the plastic case into the fastener system 1 or sliding of the plastic case out of the axial, central bore of the barrel member 7. However, often after deflagration or detonation of the solid propellant, the plastic case expands slightly and exit of the plastic case requires exertion of a minute amount of force. A relative motion of several parts of the fastener system 1 provides the minute amount of force that is needed for the exit of the plastic case. Such relative motion of several parts of the fastener system 1 is novel to the present invention and presents a unique feature that has not been presented before in existing fastener systems.

While the fastener system 1 is in a firing mode, the reset spring 18 remains compressed. After the firing mode is completed, when the handle 16 is pulled backwards until the outward circular protrusion 44 of the inner tubular member 8 is prevented from receding any further by the inward circular protrusion 46 of the cap 6, the reset spring 18 expands as the sliding guide 17 moves towards the back end 2 of the fastener system 1, leading to the locking of the front section 35 of the firing rod 12 by the pin means 19 (i.e. putting the pin means 19 in a locked position to lock the firing rod 12) until any further backward movement of the sliding guide 17 is stopped when an outwardly protruding portion of the pin means 19, that overlaps with the inward circular protrusion 87 of and that underlies the front part 38 of the sliding guide 17, prevents any further backward movement of the sliding guide 17. The pin means 19 is only locked when the reset spring 18 opens up sufficiently to push the sliding guide 17 far enough towards the back end 2 of the fastener system 1 to cause the plunging of the pin means 19 upon the front section 35 of the firing rod 12. Thus, by pulling the handle 16 backwards to close the gap between the inward circular protrusion 46 of the cap 6 and the outward circular protrusion 44 of the inner tubular member 8 as much as possible, the inner tubular member 8 is returned backwards towards the back end 2 of the fastener system 1. The outward circular protrusion 42 of the reciprocable ejector 41 overlaps with the inward circular protrusion 45 of the inner tubular member 8 to prevent the exit of the retaining section 11 and the outward circular protrusion 42 of the reciprocable ejector 41 from the inner tubular member 8. Then, by pushing the handle 16, the inner tubular member 8 moves forward towards the front end 3 of the fastener system 1. When the handle 16 is pushed forward, the inner tubular member 8 is moved forwardly longitudinally. However, the outward circular protrusion 42 and the retaining section 11 of the reciprocable ejector 41 that are slidably contained in the inner tubular member 8 do not move forwardly at the same rate as the inner tubular member 8 does and, therefore, there is a relative backward movement or penetration of the reciprocable ejector 41 into the inner tubular member 8. As the reciprocable ejector 41 moves relatively backwards when the handle 16 is pushed, the outward circular protrusion 42 of the reciprocable ejector 41 approaches the back end 10 of the inner tubular member 8 and the handle 16, causing compression of the forward spring 14 between the outward circular protrusion 42 of the reciprocable ejector 41 and the handle 16, and eventually and simultaneously the back section 36 of the firing rod 12 of the reciprocable ejector 41 penetrates into the inner tubular member 8 as well.

Following the push of the handle 16, the backward movement of the ejector housing 13 once more returns the reciprocable ejector 41 to its original position before firing. When the front part 38 of the sliding guide 17 overlies the number of perforations 40 in the back section 34 of the ejector housing 13, the sliding guide 17 again forces the pin means 19 to collapse into the number of perforations 40 and, as a result, locks the front section 35 of the firing rod 12. Before the firing rod 12 is locked, the reciprocable ejector 41 is able to move towards the back end 10 of the inner tubular member 8, thus pushing the forward spring 14 to return to its original compressed position. The backward movement of the reciprocable ejector 41 pushes the forward spring 14 towards the back end 2 of the fastener system 1. Therefore, after the deflagration or detonation of the solid propellant pill, the fastener system 1 is again returned to its original position for reloading. The fastener system 1 is then ready for receiving another solid propellant pill and another fastener.

The fastener system 1 may be actuated by pushing the handle 16 strongly enough to initiate deflagration or detonation in the solid propellant of the solid propellant pill. While ignition is effected electrically or otherwise in many fastener systems, one mode of ignition that has been contemplated for some fastener systems is effected by a physical impact with the propellant in a substantially closed chamber sealed by the fastener. In the present invention, the loaded solid propellant pill is deflagrated or detonated upon provision of sufficient friction by impacting the propellant of the solid propellant pill by the firing pin 20 of the fastener system 1. Upon pushing the handle 16 of the fastener system 1 (and, thus, starting a motion that is reciprocated by the balancing spring 15), the firing pin 20 moves via the open end or against the closed end of the solid propellant pill against the propellant, creating friction. No hammers or heavy devices are needed to initiate the movement of the reciprocable ejector 41. A simple forward movement of the handle 16 of the fastener system 1 by the hand of the user contributes to the movement of the reciprocable ejector 41 against the ejector housing 13, with the reciprocable ejector 41 itself serving as a plunger or hammer. The movement of the firing rod 12 (as a component of the reciprocable ejector 41) against the firing pin 20 (as a component of the ejector housing 13) contributes to the exertion of pressure upon the solid propellant pill, resulting in the creation of sufficient impulse to release the energy of the propellant. The release of the energy of the propellant results in immediate energization of the fastener and pushing of the fastener into the work surface.

Upon provision of an impact on the solid propellant pill by the firing pin 20, the solid propellant pill is deflagrated or detonated and an exploding force is produced to push the fastener into a work surface. In case of deflagration, the combustion gases generated by the solid propellant pill increase their pressure about the firing pin 20 as deflagration accelerates about the firing pin 20. Accordingly, in a very short time the solid propellant pill is then, along with the fastener, rapidly propelled from the fastener system 1. Under the pressure exerted upon it by the combustion gases, the fastener is energized and pushed forward into the work surface. It is not required that the fastener exactly fit the firing pin 20 of the fastener system 1. The size of the firing pin 20 is selected to provide the degree of velocity required. Only a short firing stroke of the fastener is needed.

The energy of the propellant is transmitted to the fastener to drive the fastener into the work surface. The ignition of the booster charge takes place at a distinct time interval after the explosion of the explosive powder (primary charge). This successive explosion of the primary charge and the booster charge results in a greater time interval of peak or near peak-explosive pressure than with a single power load explosive material. When the set amount of friction is surpassed, the propellant is deflagrated or detonated. If the fastener system 1 cannot restrain the fastener against peak or near peak-explosive pressure of the solid propellant pill, the fastener is propelled out of the fastener system 1. The fastener system 1 functions to drive the fastener into the work piece.

It is contemplated that the fastener system 1 can be provided with an increased stroke for driving longer fasteners, with the attendant dimensions of the components of the fastener system 1 also increased. In other words, it is contemplated that the stroke of the fastener system 1 can be altered by changing the appropriate dimensions of the constituent parts in order to drive a fastener of increased length or increased dimensions. Otherwise, the application of the fastener system 1 having increased stroke remains unchanged. With the firing pin 20 being one of the most critical components of the fastener system 1, it is desirable to have a firing pin 20 that has a diameter as large and a length as short as possible to provide as great amount of pressure as possible upon a solid propellant. Yet, the firing pin 20 should be small enough in dimensions to be capable of penetrating the solid propellant pill, and meanwhile capable of degnating the solid propellant pill.

The fastener system 1 is more economical since neither a primer nor an electrolyte is needed to propel a solid propellant pill when using the fastener system 1. A solid propellant pill is loaded into the muzzle 4 and the fastener system 1 is ready for firing. The fastener system 1 is held such that the front end 3 of the fastener system 1 is placed against the work surface, with the objective of the use of the fastener system 1 being to cause a fastener to be powerfully driven into the work surface. The handle 16 is pushed and pressure is exerted upon the firing rod 12 which transfers the pressure to the ejector housing 13. The fig pin 20, which is a component of the ejector housing 13, crushes the solid propellant pill to ignite it and thereby to enhance the driving power imparted to the firing pin 20. The propellant is ignited when sufficient friction is created by the firing pin 20 that is contacting the propellant. Thus, the effect of pushing the handle 16 is to forcefully strike front of the tube 31, and thus the firing pin 20, of the ejector housing 13 by the firing rod 12, to ignite the solid propellant pill by the firing pin 20 and to powerfully drive the fastener into the work surface. Preferably, the firing rod 12, the tube 31, the firing pin 20 and the fastener travel co-axially in the fastener system 1, with the firing rod 12 and the ejector housing 13 sliding axially through the inner tubular member 8, the outer tubular member 5 and the barrel member 7 and with the fastener moving axially away from the firing pin 20. Generally, the inner tubular member 8, the sliding guide 17 (including the main body 37 and the front part 38 of the sliding guide 17), the ejector housing 13 (including the tube 31, the outward circular protrusion 39 and the firing pin 20 of the ejector housing 13), the reciprocable ejector 41 (including the firing rod 12, the outward circular protrusion 42 and the retaining section 11 of the reciprocable ejector 41) and the fastener move co-axially in the fastener system 1.

It should not be ignored that the propellant is ignitable only at an energy that is higher than a minal set limit such that ignition does not occur at a lower-than-intended friction level. The solid propellant pill ignites less rapidly and tends to propel the fastener rather Man explosively drive it. The solid propellant pill, not having a primer, requires a substantial impact for ignition and, thus, the fastener system 1 is safer than conventional fastener systems. It should be noted that the resistive force of the work surface must be substantial or the solid propellant pill will not be ignited. In some instances, the material of the work surface into which it is desired to drive the fastener is not hard enough to produce a firing impact when the fastener strikes the work surface. Thus, if the fastener happens to be placed at a weakened section of the work surface (e.g. containing a void), the fastener and the non-ignited solid propellant pill will simply be driven into the void and the additional power of the non-ignited solid propellant pill will remain dormant.

Several significant safety features of the present invention are achieved as a result of its method of application. No hammers or other striking devices, that may cause injuries to the user, are needed by the user for initiating the fastener system 1. A simple push of the handle 16 of the fastener system 1 by the hand of the user is sufficient. However, it should be noted that the firing rod 12 that is positioned inside the fastener system 1 plays the role of a plunger or hammer, but does not come into contact with the user. There is a much greater efficiency of the driving force due to several reasons. The propellant energy is applied directly to the driving of the fastener. The force exerted by the firing pin 20 on the power pill is used to ignite the solid propellant pill. The pressure exerted by the firing rod 12 upon the firing pin 20 as the firing rod 12 slides through the tube 31 of the ejector housing 13 is used to create sufficient impulse to release the energy of the propellant. The attachment of the firing pin 20 to the tube 31 of the ejector housing 13 prohibits any leakage of corrosive gas into the fastener system 1 beyond the ejector housing 13 (i.e. into the ejector housing 13 and in contact with the firing rod 12). The fastener system 1 can be very accurately aimed at the striking point and is, thus, more reliable, efficient, safe and troublefree.

The fastener system 1 is used as a means to safely and effectively generate propellant gases from a solid propellant pill adjacent to the firing pin 20. The firing pin 20 has two ends: one end is placed as closely as possible and preferably sealed by the solid propellant pill, with the solid propellant pill being placed against the fastener, and the other end is an extension of the ejector housing 13. With the solid propellant pill being positioned in front of the firing pin 20 and with the fastener being positioned in front of the solid propellant pill, removal of spent cartridges from the fastener system 1 does not pose any matter of concern in the application of the fastener system 1.

In order to diminish energy consumption of the fastener system 1, the air volume between the solid propellant pill and the firing pin 20 is minimized whereby the energy of the firing pin 20 that is intended to ignite the solid propellant pill is used as efficiently as possible. The air volume is predeterminedly small and hence there is practically no energy wasted in igniting the propellant, substantially all the kinetic energy of the firing pin 20 being used to ignite the propellant. In addition, since there is effectively no empty space between the solid propellant pill and the fastener, expansion of the gases resulting from ignition of the solid propellant pill is minimized. A lower expansion of the gases resulting from ignition implies an application of increased energy to the fastener and, therefore, an increase in the efficiency of the fastener system 1.

Thus, basically all components of the fastener system 1 either directly or indirectly co-operate in actuation and ignition of the solid propellant pill and the firing of the fastener. The fastener system 1 has the driving capacity of previously existing high-velocity fastener systems, but the safety of previously existing low-velocity fastener systems. In addition, the fastener system 1 contains a uniquely simple structure with a minimal number of parts among existing similar marketed goods, a low noise level and reduced drivepin and work damage. As a zero stand-off fastener system 1, the fastener system 1 is operated by holding the muzzle 4 against a hardened work surface in order for the firing pin 20 to ignite or detonate the solid propellant pill. Thus, the likelihood of discharging a fastener by a zero stand-off fastener system 1 directly into an unwanted surface, such as a worker's hand, is significantly reduced. In addition, no free flight of the fastener is achieved, yet the fastener can be satisfactorily driven into a hardened work surface. Therefore, a workman may install a fastener when the fastener system 1 rests against the work surface.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and application shown and described, and accordingly, all suitable modifications and equivalents may be resorted to, falling within the scope of the invention. it is also to be understood that the following claims are intended to cover all of the generic and specific features of the invention herein described, and all statements of the scope of the invention which, as a matter of language, might be said to fall in between.

What is claimed as invention is:

1. An explosively actuated fastener system for initiating ignition of a solid propellant pill for driving a fastener into a work surface, said fastener system comprising:

(a) a front end, where the solid propellant pill and the fastener are received and disposed of, and a back end;

(b) an open-ended muzzle that is positioned adjacent to the front end of the fastener system;

(c) an open-ended outer tubular member that has a front end and a back end, that has attached to its back end an open-ended tubular cap, having a front end, a back end and an inward circular protrusion at its back end, and that contains a balancing spring;

(d) an open-ended barrel member that includes an axial, central bore, extending through the barrel member and receiving the solid propellant pill, and that extends from within, that is an integral continuation of and that connects the muzzle to the front end of the outer tubular member;

(e) an open-ended inner tubular member that has a front end and a back end and that contains a forward spring, with an outward circular protrusion and an inward circular protrusion being positioned at the front end of the open-ended inner tubular member;

(f) an ejector housing that comprises a tube, an outward circular protrusion and a firing pin extending forwardly from the tube, with the tube comprising a closed top, an open bottom, a front section that is smaller in diameter than the axial, central bore of the barrel member, a middle section and a back section, that is separated from the middle section by the outward circular protrusion and that has a number of perforations, and that accommodates a reciprocable ejector comprising a retaining section positioned in the inner tubular member, an outward circular protrusion and a firing rod that extends forwardly and is separated by the outward circular protrusion from the retaining section and that comprises a front section, a middle section and a back section, with the retaining section of and the outward circular protrusion of the reciprocable ejector being prevented from exiting the inner tubular member even while the reciprocable ejector is sliding through the outer tubular member, with a pin means being fitted in the number of perforations in the back section of the ejector housing, and with the balancing spring being fitted between the outward circular protrusion of the ejector housing and the barrel member;

(g) an open-ended sliding guide that comprises a tubular main body and a front part, having at its front edge an inward circular protrusion, and that is positioned in front of the inner tubular member and within the outer tubular member, with a reset spring being fitted around the front part of the sliding guide and being positioned between the outward circular protrusion of the ejector housing and the main body of the sliding guide; and (h) a handle that is attached to and that serves as a closure for the back end of the inner tubular member;

such that the muzzle, the barrel member, the outer tubular member, the inner tubular member, the sliding guide (including the main body and the front part of the sliding guide), the ejector housing (including the tube, the outward circular protrusion and the firing pin of the ejector housing) and the reciprocable ejector (including the firing rod, the outward circular protrusion and the retaining section of the reciprocable ejector) are co-axially aligned;

such that the fastener is placed in contact with the work surface upon being placed in entrance at the front end of the axial, central bore of the barrel member; and such that the handle, the inner tubular member, the sliding guide, the reset spring, the pin means, the forward spring, the reciprocable ejector and the ejector housing cooperate to ignite the solid propellant pill to drive the fastener into the work surface.

2. The explosively actuated fastener system according to claim 1, wherein the handle consists of a cap and a base, that is attached to a portion of the inner tubular member at the back end of the inner tubular member, that is co-axial with the cap and with the inner tubular member and that comprises a closed bottom, serving as a base for the cap and blocking passage of the forward spring, and a tubular side wall with a front edge and an open front end for insertion therethrough of the back end of the inner tubular member, and is co-axially aligned with the inner tubular member, such that the tubular side wall of the base is larger in diameter than the inward circular protrusion at the back end of the open-ended tubular cap and, thus, a portion of the inner tubular member that is covered by and is attached to the tubular side wall of the base of the handle is refrained from entering into the outer tubular member and moves along with the handle.

3. The explosively actuated fastener system according to claim 1, wherein the handle is extendable.

4. The explosively actuated fastener system according to claim 1, wherein the outward circular protrusion of the inner tubular member is larger in diameter than the inward circular protrusion of the open-ended tubular cap, such that when the handle is pulled backward, the inward circular protrusion of the back end of the cap prevents the inner tubular member from exiting the outer tubular member.

5. The explosively actuated fastener system according to claim 1, wherein the outward circular protrusion of the reciprocable ejector is larger in diameter than the retaining section of the reciprocable ejector and wherein the inward circular protrusion of the inner tubular member is smaller in diameter than the outward circular protrusion of the reciprocable ejector, such that the retaining section of and the outward circular protrusion of the reciprocable ejector are prevented by the inward circular protrusion of the inner tubular member from exiting the inner tubular member.

6. The explosively actuated fastener system according to claim 1, wherein the reciprocable ejector is centered and guided by being slidable within the inner tubular member and the ejector housing and upon being unlocked by the pin means, with the retaining section of and the outward circular protrusion of the reciprocable ejector always remaining in the inner tubular member, with the front section and the middle section of the firing rod of the reciprocable ejector always remaining in the ejector housing and with the back section of the firing rod of the reciprocable ejector moving back and forth between the inner tubular member and the back section of the tube of the ejector housing and the back section and the middle section of the tube of the ejector housing.

7. The explosively actuated fastener system according to claim 1, wherein when the front section of the firing rod of the reciprocable ejector is locked in position by the pin means, some empty space exists between the front section of the firing rod and the closed top of the tube of the ejector housing.

8. The explosively actuated fastener system according to claim 1, wherein the pin means is a pin or a pin ring.

9. The explosively actuated fastener system according to claim 1, wherein as soon as the handle is pushed, the forward spring is adapted to become compressed, the inner tubular member is adapted to move forcefully forward toward the front end of the fastener system, to forcefully strike and result in forward movement of the sliding guide, such that the front section of the firing rod of the reciprocable ejector is kept in locked position by the pin means and the forward movement of the sliding guide causes compression and exertion of pressure on the reset spring.

10. The explosively actuated fastener system according to claim 1, wherein the middle section of the firing rod of the reciprocable ejector is curved or slanted.

11. The explosively actuated fastener system according to claim 1, wherein the middle section and the back section of the firing rod are larger in diameter than the front section of the firing rod but are slightly smaller in outer diameter than inner diameter of the middle section of and the back section of the ejector housing.

12. The explosively actuated fastener system according to claim 1, wherein the front section of the firing rod has a slightly smaller outer diameter than inner diameter of the front section of the ejector housing and the front section of the firing rod is longer than distance between number of perforations and top of the middle section of the ejector housing, such that a portion of the front section of the firing rod rests in the front section of the ejector housing at all times even when the firing rod is locked by the pin means.

13. The explosively actuated fastener system according to claim 1, wherein when the fastener system is manually reset and before the handle is pushed, the forward spring is not compressed, the reset spring is not compressed, the front part of the sliding guide is over the number of perforations in the back section the ejector housing, the pin means locks the front section of the firing rod of the reciprocable ejector, a protruding portion of the pin means overlapping with the inward circular protrusion of the front part of the sliding guide prevents passage of the inward circular protrusion of the front part of the sliding guide beyond the pin means and prevents any further movement of the sliding guide toward the back end of the fastener system, the outward circular protrusion of the inner tubular member rests against the inward circular protrusion of the open-ended tubular cap, thus preventing exit of the inner tubular member from the outer tubular member, and the outward circular protrusion of the reciprocable ejector rests against the inward circular protrusion of the inner tubular member.

14. The explosively actuated fastener system according to claim 1, wherein as soon as the handle is pushed, the forward spring is adapted to become compressed, the inner tubular member is adapted to move forcefully forward toward the front end of the fastener system, forcefully strike the sliding guide, causing the sliding guide to move forward, such that the reset spring becomes compressed;

such that the main body of the sliding guide, which is larger in inner diameter than the front part of the sliding guide, moves over the pin means, with the forward spring remaining compressed and the reciprocable ejector remaining locked by the pin means, and such that (a) a portion of the front section of the firing rod of the reciprocable ejector remains in the middle section and the back section of the ejector housing and remains locked by the pin means and passage of the middle section and of the back section of the firing rod which are larger in diameter than the front section of the firing rod is prevented, (b) the middle section and the back section of the firing rod stay out of the middle section of the ejector housing and rest behind the number of perforations and the pin means, (c) the inwardly protruding pin means constrains any forward longitudinal movement of the firing rod until the sliding guide moves sufficiently towards the front end that the main body of the sliding guide is positioned over the pin means to provide sufficient space for the pin means to allow the pin means to protrude outwardly and unlock.

15. The explosively actuated fastener system according to claim 14, wherein when the main body of the sliding guide rests over the pin means, the pin means unlocks, allowing the forward spring to open up and force the reciprocable ejector to move forward in the ejector housing, with either the back section of the ejector housing moving onto and against the inward circular protrusion of the inner tubular member or a portion of the back section of the ejector housing sliding backwards into the inner tubular member, such that (a) the front section of the firing rod of the reciprocable ejector reaches front of the front section of the ejector housing, the middle section of the filing rod enters the middle section of the ejector housing, a portion of the back section of the firing rod moves forward through the open bottom of the tube into the back section of the ejector housing and a portion of the back section of the firing rod enters the middle section of the ejector housing upon passing by the opened up pin means, (b) the firing rod strikes from behind the closed top of the tube of the ejector housing, initiating deflagration or detonation of the solid propellant pill, and the back section of the firing rod fits tightly within the middle section and within the back section of the ejector housing, with the pin means protruding outwardly of the number of perforations in the back section of the ejector housing into a free space under the main body of the sliding guide, and (c) the outwardly protruding pin means constrains any longitudinal movement of the sliding guide unless sufficient amount of backward force is exerted by pulling the handle backward in order to move the reciprocable ejector backward until the front section of the firing rod of the reciprocable ejector is locked in position by the pin means.

16. The explosively actuated fastener system according to claim 1, wherein after the handle is pushed, the forward spring is adapted to become compressed, the inner tubular member is adapted to move forcefully forward toward the front end of the fastener system, forcefully strike the sliding guide, causing the sliding guide to move forward such that the reset spring becomes compressed and such that the main body of the sliding guide, which is larger in inner diameter than the front part of the sliding guide, moves over the pin means and the pin means unlocks, allowing the forward spring to open up and force the reciprocable ejector to move forward in the ejector housing, with either the back section of the ejector housing moving onto and against the inward circular protrusion of the inner tubular member or a portion of the back section of the ejector housing sliding backwards into the inner tubular member, such that (a) the front section of the firing rod of the reciprocable ejector reaches front of the front section of the ejector housing, the middle section of and a portion of the back section of the firing rod enter the middle section of the ejector housing upon passing by the opened up pin means and a portion of the back section of the firing rod moves forward through the open bottom of the tube into the back section of the ejector housing;

(b) the firing rod strikes from behind the closed top of the tube of the ejector housing, initiating deflagration or detonation of the solid propellant pill, and the back section of the firing rod fits tightly within the middle section and within the back section of the ejector housing, with the pin means protruding outwardly of the number of perforations in the back section of the ejector housing into a free space under the main body of the sliding guide; and (c) the outwardly protruding pin means constrains any longitudinal movement of the sliding guide unless sufficient amount of backward force is exerted by pulling the handle backward in order to move the reciprocable ejector backward until the front section of the firing rod of the reciprocable ejector is locked in position by the pin means.

17. The explosively actuated fastener system according to claim 1, wherein the firing rod is larger in diameter than the firing pin which extends outwardly and forwardly from the front section of and from the closed top of the ejector housing.

18. The explosively actuated fastener system according to claim 1, wherein the balancing spring is positioned between the barrel member and the outward circular protrusion of the ejector housing, such that the balancing spring encloses the front section and the middle section of the ejector housing that are in the outer tubular member.

19. The explosively actuated fastener system according to claim 1, wherein the outer tubular member consists of a raised section and a lower section, whereby:

(a) the cap is attached to the lower section farthest from the raised section at the back end of the outer tubular member;

(b) the raised section extends between the barrel member and the lower section;

(c) the lower section extends between the raised section and the inward circular protrusion of the cap; and (d) the outward circular protrusion of the ejector housing is smaller in diameter than the raised section of the outer tubular member, but is larger in diameter than the lower section of the outer tubular member;

such that the outward circular protrusion of the ejector housing moves longitudinally in the raised section of the outer tubular member but is blocked by the lower section from receding any further; and such that, since the balancing spring is positioned between the barrel member and the outward circular protrusion of the ejector housing, the raised section of the outer tubular member always encapsulates the balancing spring.

20. The explosively actuated fastener system according to claim 1, wherein the barrel member comprises a front part, that is surrounded by and is attached to the muzzle and that is inserted into an internal opening in the muzzle, a back part, that is at least partly inserted into the outer tubular member to attach the barrel member to the outer tubular member, and a middle part, that connects the front part of the barrel member to the back part of the barrel member.

21. The explosively actuated fastener system according to claim 1, wherein the muzzle has a substantially frusto-conical shape and a central bore.

22. The explosively actuated fastener system according to claim 21, wherein the muzzle comprises a front end, a back end, a cylindrical portion adjacent to the front end and a conical portion adjacent to the back end.

23. The explosively actuated fastener system according to claim 22, wherein the cylindrical portion of the muzzle has a number of cuts on its edge for pinpointing the fastener.

24. The explosively actuated fastener system according to claim 21 wherein a portion of the central bore of the muzzle is occupied by a part of the barrel member and another portion of the central bore of the muzzle remains empty and serves as a circular recess.

25. The explosively actuated fastener system according to claim 1, wherein, before pushing the handle, the solid propellant pill is positioned against the firing pin and the fastener is positioned against the solid propellant pill, such that there is effectively no empty space between the solid propellant pill and the fastener;

such that the solid propellant pill can only be viewed from the front end of the fastener system when the fastener is not present; and such that the solid propellant pill has a case that is removable after the fastener has been fired.

26. The explosively actuated fastener system according to claim 1, wherein the fastener is placed in the axial, central bore outwardly, having an inner end that is in contact with the solid propellant pill and an outer end that extends beyond the muzzle and that rests against and first strikes the work surface.

27. The explosively actuated fastener system according to claim 1, wherein the sliding guide is constrained against longitudinal movement by the pin means and by the outward circular protrusion of the ejector housing while certain compression levels are being reached during transition stages, said transition stages consisting of firing of the solid propellant pill and manual resetting of the fastener system.

28. A method of application of an explosively actuated fastener system for initiating ignition of a solid propellant pill for driving a fastener into a work surface, said fastener system comprising:

(a) a front end, where the solid propellant pill and the fastener are received and disposed of, and a back end;

(b) an open-ended muzzle that is positioned adjacent to the front end of the fastener system;

(c) an open-ended outer tubular member that has a front end and a back end, that has attached to its back end an open-ended tubular cap, having a front end, a back end and an inward circular protrusion at its back end, and that contains a balancing spring;

(d) an open-ended barrel member that includes an axial, central bore, extending through the barrel member and receiving the solid propellant pill, and that extends from within, that is an integral continuation of and that connects the muzzle to the outer tubular member;

(e) an open ended inner tubular member that has a front end and a back end and that contains a forward spring, with an outward circular protrusion and an inward circular protrusion being positioned at the front end of the open-ended inner tubular member;

(f) an ejector housing that comprises a tube, an outward circular protrusion and a firing pin extending forwardly from the tube, with the tube comprising a closed top, an open bottom, a front section that is smaller in diameter than the axial, central bore of the barrel member, a middle section and a back section, that is separated from the middle section by the outward circular protrusion and that has a number of perforations, and that accommodates a reciprocable ejector comprising a retaining section positioned in the inner tubular member, an outward circular protrusion and a firing rod that extends forwardly and is separated by the outward circular protrusion from the retaining section and that comprises a front section, a middle section and a back section, with the retaining section of and the outward circular protrusion of the reciprocable ejector being prevented from exiting the inner tubular member even while the reciprocable ejector is sliding through the outer tubular member, with a pin means being fitted in the number of perforations in the back section of the ejector housing, and with the balancing spring being fitted between the outward circular protrusion of the ejector housing and the barrel member;

(g) an open-ended sliding guide that comprises a tubular main body and a front part, having at its front edge an inward circular protrusion, and that is positioned in front of the inner tubular member and within the outer tubular member, with a reset spring being fitted around the front part of the sliding guide and being positioned between the outward circular protrusion of the ejector housing and the main body of the sliding guide; and (h) a handle that is attached to and that serves as a closure for the back end of the inner tubular member;

said method comprising:

manually resetting the fastener system by pulling the handle backward, such that upon pulling the handle backward, the front section of the firing rod underlies the number of perforations, providing additional free space for penetration of the pin means, and thus a backward movement of the sliding guide is unconstrained, such that the reset spring opens up as the inner tubular member moves towards the back end of the fastener system, and such that the sliding guide is pushed by the reset spring towards the back end, the pin means is forced by the front part of the sliding guide into the number of perforations in the back section of the ejector housing to lock the front section of the firing rod, with some distance existing between the closed top of the tube and top of the firing rod but the sliding guide is prevented by a protruding portion of the pin means from passing beyond the pin means;

removing any remaining parts of a used solid propellant pill when the propellant of the used solid propellant pill is consumed after the propellant is fired by causing a forwardly directed motion of the ejector housing;

positioning a new solid propellant pill in front of the firing pin and in the axial, central bore of the barrel member and positioning the fastener in front of the new solid propellant pill, with the fastener heading towards the work surface;

placing the muzzle against the work surface; and pushing the handle, forcing the inner tubular member to move towards the front end of the fastener system such that:

the forward spring becomes compressed in the inner tubular member between the outward circular protrusion of the reciprocable ejector and the handle and simultaneously the back section of the firing rod of the reciprocable ejector relatively penetrates into the inner tubular member, the sliding guide is pushed forward by the inner tubular member, such that the reset spring is compressed between the outward circular protrusion of the ejector housing and the main body of the sliding guide until the main body of the sliding guide moves over the number of perforations in the back section of the ejector housing, allowing the pin means to unlock, with the pin means unlocking, the compressed forward spring opens up and pushes the reciprocable ejector forward while the outward circular protrusion of the reciprocable ejector overlaps with the inward circular protrusion of the inner tubular member to prevent exit of the retaining section of and the outward circular protrusion of the reciprocable ejector from the inner tubular member and while the firing rod is unlocked and moves forward in the tube of the ejector housing that is forced to move towards the front end of the fastener system, and a portion of the back section of the ejector housing slides backward into the inner tubular member or the back section of the ejector housing moves onto and against the inward circular protrusion of the inner tubular member, the front section of the firing rod reaches the front of the front section of the ejector housing, the middle section of and a portion of the back section of the firing rod enter the middle section of and fit tightly within the middle section and a portion of the back section of the firing rod enters and fits tightly within the back section of the ejector housing, causing the pin means to protrude outwardly of the number of perforations in the back section of the ejector housing into a free space under the main body of the sliding guide, top of the firing rod strikes bottom of the firing pin and causes deflagration or detonation of the solid propellant pill and firing of the fastener and the balancing spring contributes to returning the ejector housing to its original position after deflagration or detonation, and the handle, as well as a portion of the inner tubular member at its back end that is attached to and covered by the handle, are prevented from entering into the outer tubular member by and return when striking the inward circular protrusion at the back end of the cap;

such that the inner tubular member, the sliding guide, the ejector housing, the reciprocable ejector and the fastener move co-axially in the fastener system; and such that any longitudinal movement of the sliding guide is constrained between the outward circular protrusion of the ejector housing and the pin means.

29. The method of application of an explosively actuated fastener system according to claim 28, wherein, with the solid propellant pill being in a plastic case that remains in the fastener system after the propellant is fired, the plastic case is ejected from, following the manual resetting of, the fastener system by pushing the handle, such that the ejector housing is pushed forward.

30. The method of application of an explosively actuated fastener system according to claim 28, wherein, with the solid propellant pill being in a plastic case that remains in the fastener system after the propellant is fired, the plastic case is ejected from, following the manual resetting of, the fastener system by holding the handle and pushing the outer tubular member and the barrel member backwards, such that the ejector housing is pushed forward.

31. The method of application of an explosively actuated fastener system according to claim 28, wherein as soon as the handle is pushed, the forward spring becomes compressed, the sliding guide moves forward, the reset spring becomes compressed and the main body of the sliding guide overlies the number of perforations in the back section of the ejector housing, such that the pin means unlocks, allowing the forward spring to open up and force the reciprocable ejector to move forward in the ejector housing, such that upon unlocking of the pin means:

(a) the front section of the firing rod of the reciprocable ejector reaches front of the front section of the ejector housing, the middle section of and a portion of the back section of the firing rod enter the middle section of the ejector housing upon passing by the opened up pin means and a portion of the back section of the firing rod moves forward through the open bottom of the tube into the back section of the ejector housing;

(b) the back section of the firing rod fits tightly within the middle section and within the back section of the ejector housing, with the pin means protruding outwardly of the number of perforations in the back section of the ejector housing into a free space under the main body of the sliding guide; and (c) the outwardly protruding pin means constrains any longitudinal movement of the sliding guide unless sufficient amount of backward force is exerted by pulling the handle backward in order to move the reciprocable ejector backward until the front section of the firing rod of the reciprocable ejector is locked in position by the pin means.

32. The method of application of an explosively actuated fastener system according to claim 28, wherein the protruding portion of the pin means stops any further backward movement of the sliding guide by stopping any further backward movement of the inward circular protrusion, with the protruding portion of the pin means overlapping with the inward circular protrusion, of the front part of the sliding guide.

* * * * *